US009544950B2

(12) United States Patent
Baskerville et al.

(10) Patent No.: US 9,544,950 B2
(45) Date of Patent: Jan. 10, 2017

(54) ELECTRIC INDUCTION HEATING AND COATING OF THE EXTERIOR SURFACE OF A PIPE

(71) Applicant: Inductotherm Heating & Welding Limited, Hampshire (GB)

(72) Inventors: Stephen William Baskerville, Reading (GB); Derek Humphries, Hampshire (GB); John W. Betteridge, Essex (GB); William Fenwick, Durham (GB); Michael Lee, Wokingham (GB)

(73) Assignee: Inductotherm Heating & Welding Ltd (GB)

( * ) Notice: Subject to any disclaimer, the term of this patent is extended or adjusted under 35 U.S.C. 154(b) by 364 days.

(21) Appl. No.: 13/875,663

(22) Filed: May 2, 2013

(65) Prior Publication Data

US 2014/0295100 A1 Oct. 2, 2014

Related U.S. Application Data

(60) Provisional application No. 61/806,110, filed on Mar. 28, 2013.

(51) Int. Cl.

| | |
|---|---|
| ***B05B 3/00*** | (2006.01) |
| ***B05C 13/02*** | (2006.01) |
| ***B05B 5/025*** | (2006.01) |
| ***H05B 6/10*** | (2006.01) |
| ***H05B 6/36*** | (2006.01) |

(Continued)

(52) U.S. Cl.

CPC ..... *H05B 6/36* (2013.01); *B05B 13/0436* (2013.01); *B05C 9/14* (2013.01); *B05D 3/0281* (2013.01); *B05D 7/146* (2013.01)

(58) Field of Classification Search

USPC ..... 118/323, 325, DIG. 11, 620, 623, 627; 219/643, 674; 427/543

See application file for complete search history.

(56) References Cited

U.S. PATENT DOCUMENTS

| | | | |
|---|---|---|---|
| 4,595,607 | A | 6/1986 | Betteridge et al. |
| 5,186,755 | A | 2/1993 | Carlson, Jr. et al. |

(Continued)

FOREIGN PATENT DOCUMENTS

| | | | |
|---|---|---|---|
| GB | 2285592 | A | 7/1995 |
| GB | 2285596 | A | 7/1995 |

(Continued)

*Primary Examiner* — Yewebdar Tadesse
(74) *Attorney, Agent, or Firm* — Philip O. Post

(57) ABSTRACT

A modular electric induction heating and coating apparatus and method for coating, heating and/or coating and heating (and vice versa) the exterior surface of a pipe section within a pipe treatment region is provided. The apparatus comprises an interchangeable central main frame assembly removably attached to an outer drive frame assembly on each side of the central main frame assembly. An interchangeable induction coil assembly can be mounted in a coil main frame assembly of the central main frame assembly. The coil main frame assembly can close around a pipe section for electric induction heating of the pipe section within the pipe treatment region via a driver system in a central top drive frame assembly. The outer drive frame assemblies include mounting and rotational drive assemblies for interchangeable coating head cartridges that can coat the section of the pipe in the pipe treatment region.

17 Claims, 28 Drawing Sheets

(51) Int. Cl.

| | |
|---|---|
| ***B05C 9/14*** | (2006.01) |
| ***B05D 7/14*** | (2006.01) |
| ***B05D 3/02*** | (2006.01) |
| ***B05B 13/04*** | (2006.01) |

(56) References Cited

U.S. PATENT DOCUMENTS

| | | | | |
|---|---|---|---|---|
| 5,238,331 | A | 8/1993 | Chapman | |
| 7,105,204 | B2 | 9/2006 | Betteridge | |
| 2005/0013941 | A1* | 1/2005 | Betteridge | B05B 13/0489 427/421.1 |
| 2011/0311716 | A1 | 12/2011 | Taylor et al. | |

FOREIGN PATENT DOCUMENTS

| | | | |
|---|---|---|---|
| WO | 90/07984 | A2 | 7/1990 |
| WO | 9007984 | | 7/1990 |
| WO | 9007984 | A2 | 7/1990 |
| WO | 2009/024755 | A1 | 2/2009 |

* cited by examiner

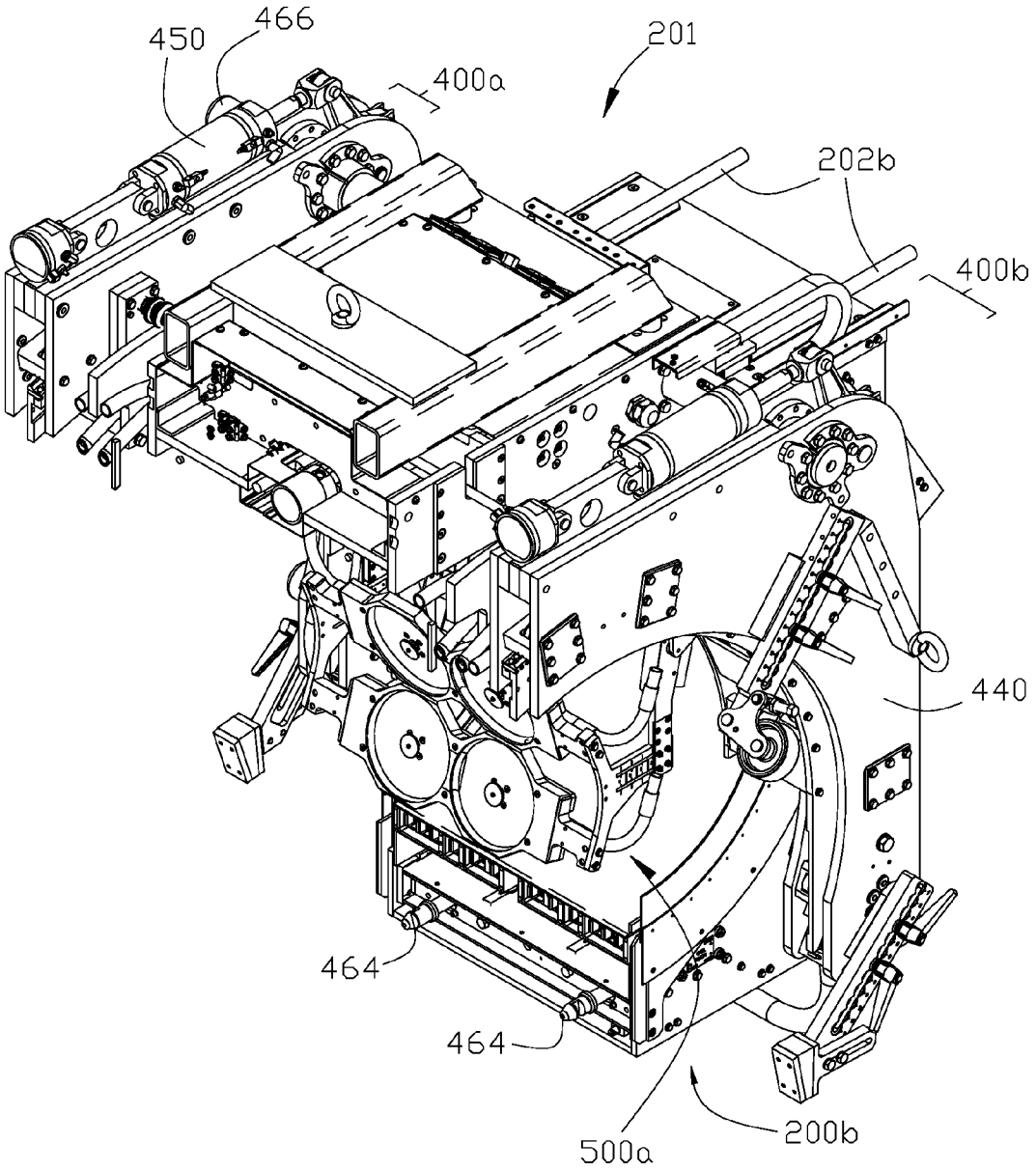
FIG. 5(b)
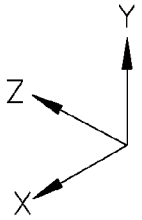

LEGEND

ROTATING INDUCTOR ASSEMBLY -

ROTATING COATING HEAD ASSEMBLY -

ELECTRIC INDUCTION HEATING AND COATING OF THE EXTERIOR SURFACE OF A PIPE

CROSS REFERENCE TO RELATED APPLICATIONS

This application claims the benefit of U.S. Provisional Application No. 61/806,110, filed Mar. 28, 2013, hereby incorporated by reference in its entirety.

FIELD OF THE INVENTION

The present invention relates to apparatus for, and method of heating or coating, or a combination of heating and coating the exterior surface of a pipe particularly in the combined heating and coating mode when the pipe may be heated prior or subsequent to the application of a coating or an insulation wrap to the pipe's exterior surface, and where the apparatus comprises a combined electric induction heating apparatus and coating apparatus that is modular in order to allow use as a combined heating and coating apparatus, or as an independent heating or coating apparatus.

BACKGROUND OF THE INVENTION

WO 2009/024755 A1 discloses an apparatus for induction heating and spray coating of the exterior surface of a pipe where the induction heating coil and coating applicator are located side by side around a longitudinal section of a pipe (or weld region of two adjoining pipe sections) of a particular diameter. The apparatus comprises separate stator and rotor frames, with the rotor frame being rotationally mounted to an end face of the stator frame so that the rotor frame can rotate relative to the stator frame. The stator frame is formed from two semicircular sections that are pivotally connected together at one end so that the stator frame can be opened to mount the section of pipe and closed around the outer diameter of the pipe. Electric conductors are disposed between the two end faces of the stator frame so that they surround the outer diameter of the section of the pipe within the stator. A coating applicator is mounted to the rotor frame, which is axially outboard of the stator frame, so that the applicator can be rotated around the pipe to coat the entire outer circumference while the rotor frame remains fixed in position, or is rolled along the axial length of the pipe. The coating applicator can also be moved longitudinally relative to the pipe while the stator frame is stationary.

One disadvantage of the apparatus in WO 2009/024755 A1 is that the coating applicator is located external to the induction heating coil along the axial length of the pipe, and the apparatus must be axially moved along the length of the pipe section to first coat and then heat a section of the pipe and/or first heat and then coat a section of the pipe.

The prior art heating and coating apparatus 800 shown in FIG. 1(*a*) through FIG. 1(*f*) solves the above disadvantage by locating permanently one or more fixed position coating head assemblies 810 fitted within the axial length (along the Z-axis) of the induction heating coil (not shown in the figures for clarity) surrounding a section of pipe 90 passing through the central opening of apparatus 800 as illustrated in FIG. 1(*d*).

In apparatus 800 the one or more coating head assemblies 810 are located within and attached to rotating inner carriage 820 that has an axial length of $z_1$ as shown in FIG. 1(*b*). The inner carriage is driven and rotates around pipe 90 by means of a set of sprocket wheels 840 located on each side of the inner carriage. The sprocket wheels engage into chain slots 850 as shown in FIG. 1(*e*). Rotation of a commonly coupled drive shaft 830 results in similar rotation of the sprocket wheels causing engagement in chain guides and rotational movement of the inner carriage 820 and the one or more coating head assemblies 810 around the outer diameter of a pipe. The master drive shaft coupling 890 shown in FIG. 1(*f*) can be controlled via an electric or pneumatic motor, or other rotational driver. Apparatus 800 opens and then closes around the outer diameter of a pipe by "clam shell action" of lower apparatus halves 800*a* and 800*b* with the clam shell action created by the movement of cylinders and linkage bars 880 acting on hinge pivot points 870 and 871 for parting and joining of the lower apparatus halves at parting line 801 in FIG. 1(*f*). An induction coil is permanently located inside the main device frame in the form of a number of flexible water cooled conductors (not shown for clarity). The conductors would be located within the holes shown in inductor support bars 860 (as best seen in FIG. 1(*d*)) that are spaced around the perimeter of the main device frame. The induction coil electric circuit is made when closed and broken when opened by means of a series of electric wiping contacts 861 as shown in partial cross sectional FIG. 1(*d*) when the clam shell action described above takes place. Vertical plenum 812 provides a means to mechanically interface the apparatus 800 to other mechanical or structural devices not included in this description and may also allow means for ducting electrical supplies, cooling water and coating material supplies to the apparatus.

A disadvantage of apparatus 800 is that the combination of the permanently mounted one or more coating head assemblies 810 and permanently located induction heating coil assembly do not permit independent change of the coating head and/or coil assemblies from the apparatus structural frame and from the drive assembly for the coating head assemblies so that different configurations of coating head and/or coil assemblies can be substituted into the structural frame of the apparatus and/or the drive assembly for the coating head assemblies. Therefore the apparatus 800 in any one totally configured arrangement can only be used to heat and coat one particular outer diameter of pipe, which increases costs for a user of the apparatus if the user requires heating and coating of pipes having various diameters. A second disadvantage of apparatus 800 is that the electrical contacts 861 cannot easily be exchanged or replaced without removal of the electrical conductors and breakage of the water cooling circuit since the induction coil assembly can not be removed from apparatus 800 as a unitary assembly for direct access to the contacts and the contacts' mounting elements; whilst the contacts themselves form a permanently assembled part of the mechanical structure of the induction coil conductor and its associated water cooling path.

It is one object of the present invention to provide interchangeable axially aligned coating head and induction coil heating assembly tooling sets that can be inserted and removed as a cartridge from a common apparatus frame that contains the drive for the coating heads and other necessary support mechanisms; whilist the contacts themselves form a permanently assembled part of the mechanical structure of the induction coil conductor and its associated water cooling path.

It is another object of the present invention to provide a combined electric induction heating and coating apparatus for the exterior surface of a pipe where the electric induction heater and coating head assembly can be arranged relative to the drive for the coating heads so that pipes in a range of outer diameters can be accommodated within the same combined electric induction heating and coating apparatus using interchangeable tooling sets (cartridges) and coating head assemblies.

It is another object of the present invention to provide the ability to use the combined electric induction heating and coating apparatus in either a "heating only" mode or "coating only mode" independently, as well as a combined "heating and coating" mode by means of interchangeable tooling set (cartridges) for the induction coil and the coating head assemblies.

It is another object of the present invention to provide a method for establishing a high accuracy of heating temperature profile for the section of the pipe being heated by utilizing specifically designed and precise manufactured induction coil assemblies that are specific to the requirements of the heating process and can be interchanged for other specific induction coil assemblies to alter the performance of the combined electric induction heating and coating apparatus of the present invention to suit specific application requirements.

It is another object of the present invention to provide the ability to change the coating applicators or coating head assemblies both in arrangement and design to allow easily the adaption of the combined electric induction heating and coating apparatus of the present invention to different coating requirements.

It is another object of the present invention to provide the ability to change the heating induction coil arrangement and design to allow easily the adaption of the combined electric induction heating and coating apparatus of the present invention to different heating requirements.

It is another object of the present invention to allow a particular or any configuration of heating induction coil (or other type of inductor) and/or coating head assembly to be used for a range of applications, pipe outer diameters, pipe wall thicknesses, and coating requirements by simple adjustment or by more specific re-tooling or setting.

It is another object of the present invention to give flexibility of operation and improved maintainability of a combined electric induction heating and coating apparatus by making the electrical contacts of the induction coil (or other type of inductor) easily replaceable and of such a design that facilitates good life-time and operational efficiency.

It is another object of the present invention to provide a combined electric induction heating and coating apparatus that can be used in variable and changing angles of perspective relative to horizontal or vertical pipe position as required by the position of the pipe.

BRIEF SUMMARY OF THE INVENTION

In one aspect, the invention is apparatus for, and method of providing a combined electric induction heating and coating of the exterior surface of a pipe section where the application of the induced heating of the pipe and the coating material are achieved in the same circumferential surface around the exterior of a pipe section in a pipe treatment region, and can be simultaneously, consecutively or independently applied, controlled or otherwise engaged.

In another aspect, the invention is apparatus for, and method of providing a combined electric induction heating and coating of the exterior surface of a pipe section where the application of the induced heating of the pipe and the coating material are achieved in the same circumferential surface around the exterior of a pipe section in a pipe treatment region, and the induction coil assembly associated with the application of the induced heat can be mounted or dismounted from the apparatus without affecting the coating components on the apparatus.

In another aspect, the invention is a versatile and cost efficient apparatus for, and method of providing combined electric induction heating and coating of the exterior surface of a pipe section where the application of the induced heating of the pipe and the coating material are achieved in the same circumferential surface around the exterior of a pipe section in a pipe treatment region by providing modular interchangeability of the induction coil assembly suitable for a wide range of pipe diameters and independent interchange of coating heads.

In another aspect, the invention is a versatile and cost efficient apparatus for, and method of providing combined electric induction heating and coating of the exterior surface of a pipe section where the application of the induced heating of the pipe and the coating material are achieved in the same circumferential surface around the exterior of a pipe section in a pipe treatment region and by providing modular interchangeability of the induction coil assembly suitable for a wide range of heat affected length and by use of independent interchange of different width coating heads, a wide range of coating widths, through reconfiguration of the main component assemblies of the apparatus and/or exchange of tooling within the apparatus.

In another aspect, the invention is apparatus for, and method of providing a combined or non-combined electric induction heating and coating of the exterior surface of a pipe section where the application of the induced heating of the pipe and the coating material are achieved in the same circumferential surface around the exterior of a pipe section in a pipe treatment region, and the induction coil assembly associated with the application of the induced heat can be mounted or dismounted from the apparatus without affecting the coating components on the apparatus to allow a coating only application. Or alternatively the coating assemblies can be mounted or dismounted from the apparatus without affecting the heating assembly components on the apparatus to allow a heating only application.

These and other aspects of the invention are set forth in the specification and the appended claims.

BRIEF DESCRIPTION OF THE DRAWINGS

The figures, in conjunction with the specification, illustrate one or more non-limiting modes of practicing the invention. The invention is not limited to the illustrated layout and content of the drawings.

FIG. 1(*b*) is an isometric cross sectional view of the prior art apparatus shown in FIG. 1(*a*) through a Y-Z plane to illustrate a coating head assembly axially aligned with an induction coil.

FIG. 1(*c*) is an isometric end section view of the prior art apparatus shown in FIG. 1(*a*) with end plates removed at one end to show the drive for the coating heads at one end of the apparatus and the clam shell action closing and opening components of the apparatus.

FIG. 1(*d*) is an isometric sectioned view of the prior art apparatus shown in FIG. 1(*a*) with a typical pipe section inserted and showing the supports and contacts of the internal induction coil.

FIG. 1(*e*) is an isometric partial side view of the prior art apparatus shown in FIG. 1(*a*) with drive sprockets and drive shaft identified on either side of the apparatus.

FIG. 1(*f*) is an end view of the prior art apparatus shown in FIG. 1(*a*) showing the position of the master drive shaft coupling on the end of the apparatus where a suitable drive mechanism can be mounted, and further illustrates the location of the clam shell opening and closing mechanisms.

FIG. 2(*b*) is a back elevation view of the apparatus shown in FIG. 2(*a*).

FIG. 2(*c*) is an isometric cross sectional view of the apparatus shown in FIG. 2(*a*) through a Y-Z plane with an interchangeable coating head cartridge dismounted from the coating head mounting frame (structure) of the apparatus and a detail view "A" of inductor coil turns in an induction coil assembly mounted in the coil main frame assembly of the apparatus.

FIG. 2(*d*) is an isometric view of the apparatus shown in FIG. 2(*a*) with the removable induction coil assembly dismounted from the coil main frame assembly of the apparatus.

FIG. 2(*e*) illustrates the two (left and right hand) half sections of the induction coil assembly shown removed from the apparatus in FIG. 2(*d*).

FIG. 2(*f*) is a detail view "B" of the right hand half section of the induction coil assembly shown in FIG. 2(*e*).

FIG. 2(*g*) is a detail view of one example of electrical contacts used in the left and right hand half sections of the induction coil assembly shown in FIG. 2(*e*).

FIG. 2(*h*) is a disassembled side elevation view of the central main frame assembly, and the left and right side outer drive frame assemblies of the apparatus shown in FIG. 2(*a*).

FIG. 2(*i*) and FIG. 2(*j*) are disassembled side elevation views of the central main frame assemblies, and left and right hand side outer main frame assemblies illustrating the ability to change the axial length of the pipe section within the apparatus for heating and/or coating in the pipe treatment region by using modified central main frame assemblies with identical left and right side outer drive frame assemblies.

FIG. 3(*b*) is the isometric cross sectional view of the apparatus shown in FIG. 3(*a*) with the outer (outboard) cover plate for the right hand side outer drive frame assembly removed; detail "D" of a female contact and shroud in an induction coil assembly half; and detail "E" showing a partial example of a coil assembly mounting structure utilized in the present invention.

FIG. 3(*c*) is a right side elevation of the apparatus shown in FIG. 2(*a*) with the outer cover plate for the right hand side outer drive frame assembly removed, revealing a gearbox and drive sprockets in detail view "F" that are associated with the arcuate rack and rotationally powered drive pinion of a coating head drive assembly utilized in the present invention.

FIG. 4(*b*) is an isometric cross sectional view of the apparatus shown in FIG. 4(*a*) with the coating head cartridge in a different position than that shown in FIG. 4(*a*).

FIG. 4(*c*) is an isometric cross sectional view of the apparatus shown in FIG. 4(*b*) with the outer cover plate for the right hand side outer drive frame assembly removed.

FIG. 5(*b*) is an isometric cross sectional view of the apparatus shown in FIG. 5(*a*).

FIG. 5(*c*) is the isometric cross sectional view of the apparatus shown in FIG. 5(*a*) with the outer cover plate for the right side outer drive frame assembly removed.

DETAILED DESCRIPTION OF THE INVENTION

Figure 6A:
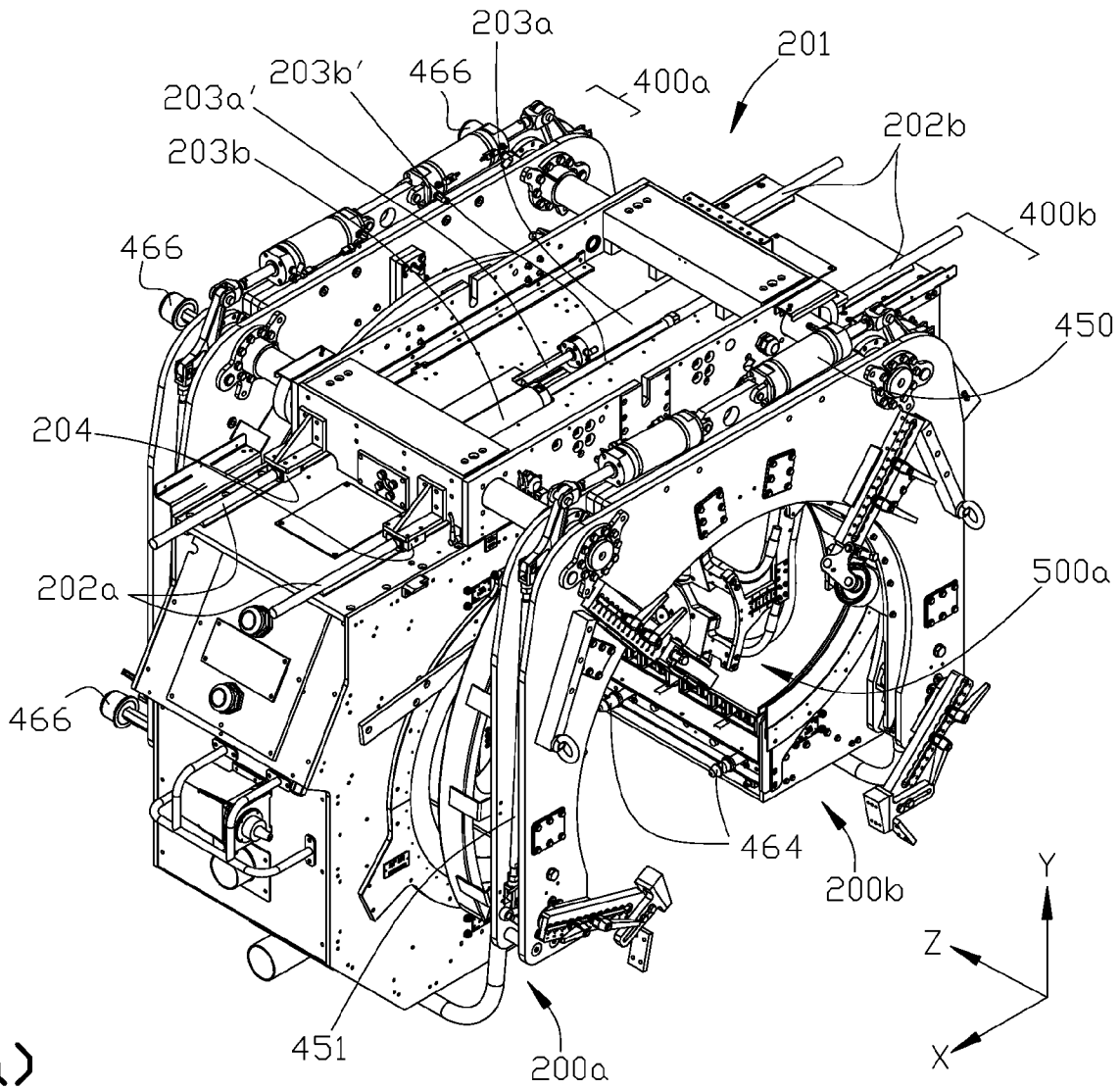
FIG. 6(*a*) and FIG. 6(*b*) are isometric views of the apparatus of FIG. 2(*a*) illustrating arrangement of the coil main frame assembly in the opened and closed positions respectively, exposing the mechanism in the central top drive frame assembly that includes the coil main frame assembly driver system for moving the coil main frame assembly from a closed coil main frame assembly position to an opened coil main frame assembly position.
Figure 6B:
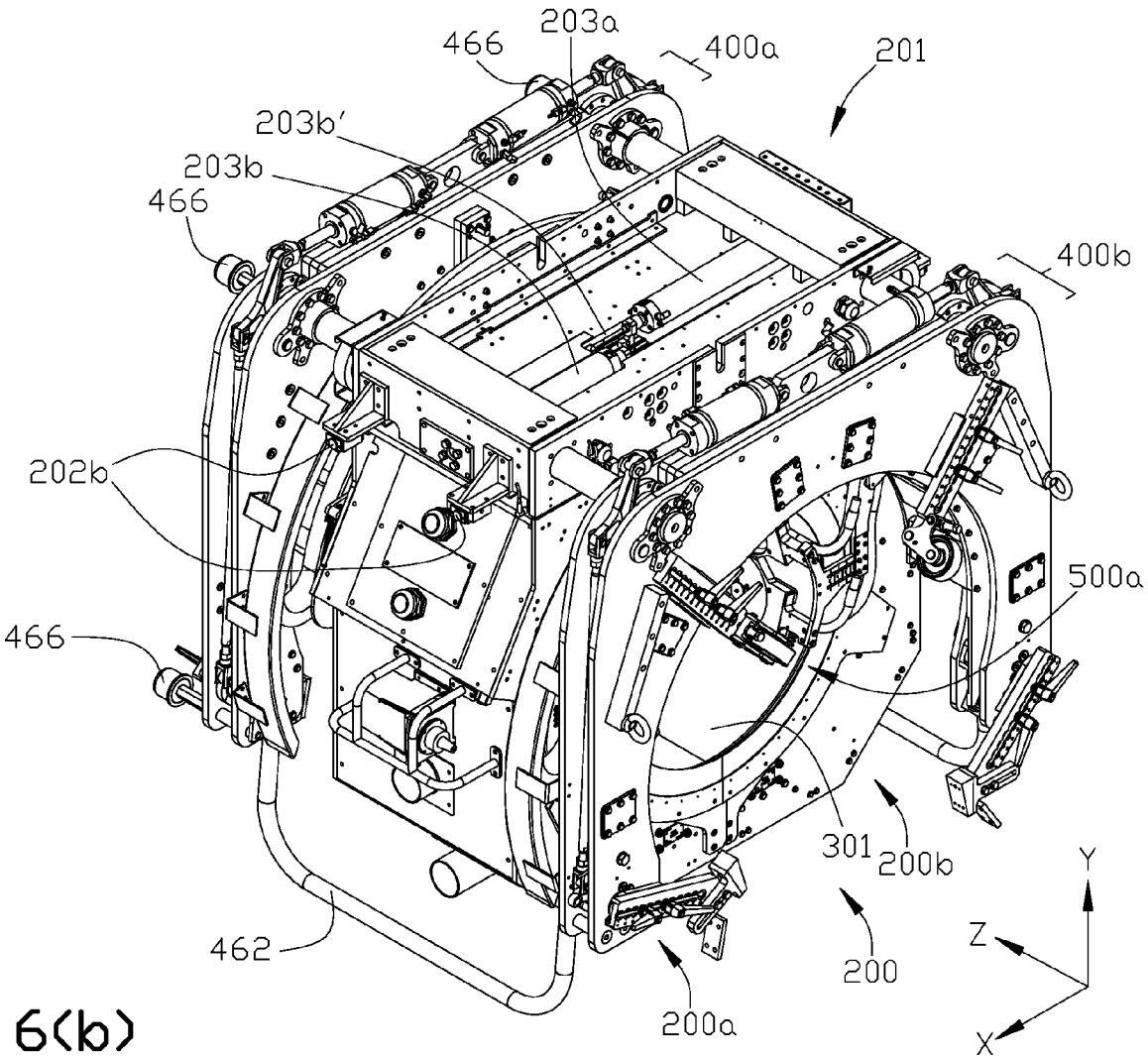

There is shown in FIG. 2(*a*) through FIG. 6(*b*) one example of the combined electric induction heating and coating apparatus 100 of the present invention. As described elsewhere, modular apparatus 100 may operate in a combination heating and coating mode; a heating only mode; or a coating only mode. The terminology "combined heating electric induction heating and coating apparatus" is commonly used herein for convenience to describe apparatus 100 regardless of the particular mode of operation, and therefore the configuration of the modular apparatus of the present invention as disclosed herein. The term "coating the exterior surface of a pipe" as used herein includes coating a material applied to the exterior surface of a pipe such as an insulation wrap.

In this example of the invention, with reference to FIG. 2(*b*), apparatus 100 comprises: an interchangeable central main frame assembly 460 that is removably connected to left and right hand side outer drive frame assemblies (400*a* and 400*b* respectively). The right hand side outer drive frame assembly 400*b* may also be referred to as the first side outer drive frame assembly, and the left hand side outer drive frame assembly 400*a* may also be referred to as the second side outer drive frame assembly, or vice versa, since as described below the two outer drive frame assemblies are mirror image to each other. The central main frame assembly 460 comprises a central top drive frame assembly 201 to which mounts a coil main frame assembly 200, that in this example of the invention comprises coil main frame assembly halves 200*a* and 200*b*. Optional bumper skids 462 are connected across the central main frame assembly 460, between the left and right hand side outer drive frame assemblies 400*a* and 400*b* to allow safe seating of the apparatus as well as protection of the apparatus during handling to and from the pipe. In other examples of the invention different components may replace the functions of the bumper skids. Optional bumpers or landing pads 466 can be permanently or removably provided on one or both outboard ends of the left and right hand side outer drive frame assemblies for seating apparatus 100 on a horizontal surface in a vertical apparatus orientation to the horizontal surface (that is, Z-axis shown in the drawings being perpendicular to the horizontal surface). In the examples of the invention shown in the figures landing pads are shown only on the outboard ends of the left hand side (400*a*) outer drive frame assembly.

The coil main frame assembly 200 includes a coil assembly mounting structure to which a modularly removable and interchangeable induction coil assembly 300 can be mounted as further described below. The induction coil assembly may also be referred to as an induction coil cartridge or tooling set. The coil assembly mounting structure may comprise an array of fasteners 260 as exemplary shown in detail "E" of FIG. 3(*b*) that fasten the induction coil assembly 300 to the coil main frame assembly 200 for rapid installation, removal or interchangeability of the induction coil assembly 300.

Referring now to FIG. 2(*h*), in this example of the invention, the main common frame components of modular apparatus 100 are illustrated disassembled as the central main frame assembly 460, the left hand side outer drive frame assembly 400*a* and the right hand side outer drive frame assembly 400*b*. The central main frame assembly 460 comprises the coil main frame assembly 200 suitably mounted to the central top drive frame assembly 201 by means of transverse linear slide bearings 202*a* and 202*b* in this example of the invention.

A modularly removable induction coil assembly 300, which in this example of the invention comprises two coil assembly halves 300*a* and 300*b* as best seen in FIG. 2(*e*), can be installed in the coil main frame assembly 200 by means of a coil assembly mounting structure as described above. Other configurations of removable induction coil assemblies can be used in other examples of the invention.

The left hand side outer drive frame assembly 400*a* and the right hand side outer drive frame assembly 400*b* provide the necessary coating head mounting structure for one or a number of interchangeable coating head cartridges 500. The coating head cartridge may also be referred to as a coating head assembly or tooling set.

An interchangeable coating head cartridge 500, which in this example of the invention comprises coating head cartridge 500 as best seen in FIG. 2(*c*), can be mounted as required to the side outer drive frame assemblies 400*a* and 400*b*.

Other configurations of interchangeable coating head cartridges can be used in other examples of the invention.

Apparatus 100 can be reconfigured in part as illustrated, for example, in FIG. 2(*i*) and FIG. 2(*j*) to suit heating and/or coating different axial lengths of pipe within apparatus 100 by changing selected components of the central main frame assembly, namely the coil main frame assembly 200, the central top drive frame assembly 201 and tie-bars (rods) 467 and bumpers 462 (if fitted). For example in one example of a modified central main frame assembly 460' in FIG. 2(*j*), coil main frame assembly 200; interchangeable induction coil assembly 300 (if used in the coil main frame assembly); interchangeable coating head cartridges 500 (if used); and tie-bars 467 would be modified whilst the central top drive frame assembly 201 could remain without change if powered drivers contained therein are rated to drive the modified coil main frame assembly and the modified coat head cartridges. That is, for example, by changing selected components in the central main frame assembly 460 in FIG. 2(*i*) to a modified central main frame assembly 460' (with original central top drive frame assembly 201 in this example and modified coil main frame assembly 200', plus modified tie-bars 467' and modified bumpers 462' (if fitted)) in FIG. 2(*j*) while using the same right and left outer drive frame assemblies (400*a* and 400*b*) a modified pipe treatment region with pipe axial length of L' (in lieu of pipe axial length of L in FIG. 2(*i*)) is formed when the modified central main frame assembly is in the closed coil main frame assembly position. Therefore all of the components of the left and right hand side outer drive assemblies, including the coating head mounting structures and coating head drive assembly, can be used with the modified central main frame assembly. The modularity of the apparatus of the present invention provides for the use of the apparatus in multiple applications with different heating and/or coating requirements without substituting a unique complete prior art apparatus for each of the multiple applications. The term "pipe" includes pipe sections that are previously joined together with the previously joined pipe sections being induction heat treated and/or coated within the pipe treatment region as described herein.

If the powered drivers contained in the central top drive frame assembly are not rated sufficiently to drive the modified coil main frame assembly and the modified coating head cartridges, then a modified central main frame assembly 201' would also be required.

Attention is now directed to the removable and interchangeable induction coil assembly 300 that can be mounted in the centralized coil main frame assembly 200 for operation, and can be installed and removed without specialized assembly and disassembly techniques. In this particular example of the invention, the induction coil assembly 300 comprises two coil assembly halves 300*a* and 300*b* that are also referred to as left hand (or first side) coil assembly half 300*a* and right hand (or second side) coil assembly half 300*b* as shown most clearly in FIG. 2(*e*). In this particular example of the invention, water cooled inductors (induction coils), where water is supplied to and returned from the interior volume of hollow inductors, are illustrated as being installed in induction coil assembly 300 due to a typical power density requirement for an application, but in other examples of the invention water cooling may not be required. The induction coil assembly 300, in this particular example of the invention, comprises a water only connection side (half 300*a*) and a power and water connection side (half 300*b*).

Water supply and return to the induction coil assembly can be accomplished by any suitable method. Likewise electric power supply to the induction coil assembly can be accomplished by any suitable method.

Supply connections for water and power enter apparatus 100 via glands (bushings) 705 and 707 on port assembly 700 as shown in FIG. 2(*d*) and port assembly 701 on the opposing side of the apparatus (hidden from view in FIG. 2(*d*)) respectively.

In one example of the invention, and as depicted in FIG. 2(*d*), water hoses made from non-conductive rubber hose or similar material can enter apparatus 100 via glands (bushings) 705 on port assembly 700 and connect, with quick release push-on connections 702, to the induction coil cooling water connections. In this instance port assembly 700 is providing water supply and return connection for one half (left hand side) of the induction coil.

In reciprocation on port assembly 701 (hidden from view in FIG. 2(*d*)) combined water and electric power media carrying bodies, commonly known in the art as flexible water cooled cables, can enter the apparatus 100 via glands (bushings) 707, and are used to carry water and electrical power to apparatus 100. Connections 703 accept the water supply and return, similarly to connections 702. Supply of electrical power can be made by known methods of electrical busbar termination at connection point 704.

As shown in FIG. 2(*e*), in this example of the invention, induction coil assembly 300 comprises a number of coil turns or conductors 302 as required for a particular application. Conductors 302 can be mounted in a rigid frame 303 and arranged to give the desired heating effect to the surface of a pipe in the pipe treatment region when the induction coil assembly is installed in the coil main frame assembly within apparatus 100 for a particular application. FIG. 2(*a*) illustrates pipe 90 (shown in phantom outline) with the coil main frame assembly in the closed position to form an encircling closed coil main frame assembly around an axial section of the pipe in the pipe treatment region. In this example of the invention, the coil conductors in the left hand induction coil assembly half 300*a* and right hand induction coil assembly 300*b* mate to form a complete closed electrical circuit around the outer surface of a section of pipe 90, known as a solenoid coil, when the coil main frame assembly is in the closed coil main frame position. That is the induction coil assembly mounted in the coil main frame assembly moves with the coil main frame assembly, by means of actuators in the central top drive frame assembly, to the: (1) closed coil main frame assembly position to form an encircling closed interchangeable induction coil assembly around the exterior surface of the pipe in the axial section of a pipe in the pipe treatment region; and to the (2) opened coil main frame assembly position to form the opening for the entry or exit of the axial section of the pipe to or from the pipe treatment region.

In this example of the invention, with the illustrated induction coil assembly 300, conductors 302 can be adjustably arranged to give a desired heating effect. As shown in FIG. 2(*e*), the specific positioning of conductors or coil turns assembled in one or more groups can be adapted in an application by means of adjustments to the assembly in order to tailor the heating application to suit the specific application requirements. A conductor group can be adjustably moved in the Z-direction (depicted by the doubled head arrow in FIG. 2(*e*)) by using suitable positioning and fastening means, such as one or more access screws 304 shown in FIG. 2(*f*) and locking bar 305 shown in FIG. 2(*e*). Screws 304 connect through slotted openings 312 in support element 314 to locking bar 305 on the opposing side of the support element 314 to accomplish the repositioning of a conductor group. In alternative examples of the invention, only a single group of coil turns may be used with means for adjusting the location of the single group of coil turns.

The coil conductors in the left hand induction coil assembly half 300*a* and right hand induction coil assembly 300*b* mate by means of complimentary pairs of female electrical contacts 306 and male electrical contacts 307 as best seen in FIG. 2(*g*) that are suitable for use in electric induction heating applications and are easily removed from the connected coil turns to allow contact replacement, for maintenance and renewal reasons during operation, as depicted in FIG. 2(*e*) and FIG. 2(*f*). When the induction coil assembly is installed in the coil main frame assembly and the coil main frame assembly is in the closed coil main frame position, opposing complimentary pairs of female (306) and male (307) electrical contacts in each induction coil assembly half mate to form continuous induction coils.

The contact surfaces of the female and male contacts can be electro-plated with, for example silver or otherwise treated, to provide a lubricated long life surface.

Contacts 306 and 307 can be protected from contamination when engaged as a mated pair by enclosing them in specially shaped shrouds (female shroud 308 and male shroud 309) as shown in FIG. 2(*e*) and FIG. 2(*f*) to form contact assemblies. These shrouds can be arranged to be not air tight so that when purged internally with positive air pressure ingress of external contaminants into the regions of the contacts and contact assemblies can be prevented. Detail "D" in FIG. 3(*b*) illustrates female contacts 306 and shrouds 308 in an induction coil assembly half installed in a coil main frame assembly. In one embodiment of the invention the apparatus control system initiates the internal induction coil assembly positive air pressure purge apparatus during a closed apparatus treatment cycle when the coil main frame assembly is in the closed coil main frame assembly position to prevent contamination and upon transition to an opened apparatus standby cycle when the coil main frame assembly is in the opened coil main frame assembly position to keep the contacts and contact assemblies clear of contaminants.

If the inductor(s) and circuit configuration for a particular application of the invention do not require an electrical connection between the left hand induction coil assembly half 300*a* and right hand induction coil assembly half 300*b*, then a contact system is not required for the induction coil assembly.

In other embodiments of the invention, alternative arrangements of electrical conductors within a removable induction coil assembly may be utilized to provide the required induced heating effect. Such examples are, but not limited to, transverse flux inductors, pancake inductors, strip inductors, split-return inductors and hairpin inductors utilizing one or more electrical circuits. Optionally magnetic flux field intensifiers, distributors, field directing or field adjusting elements or devices may be used with any electrical inductor to provide the necessary heating effect.

Further in other examples of the invention, the removable induction coil assembly may be formed as a non-split coil assembly (if opening and closing around a pipe is not required) or consist of multiple segments other than two half coil assemblies.

Any particular inductor configuration in a given induction coil assembly for an application can be used for heating a defined range of pipe diameters and wall thicknesses. Where any particular apparatus 100 is required to heat a range of pipe diameters or wall thicknesses other than in the defined range, then an alternative inductor configuration in an alternative induction coil assembly 300 may be required. Due to the modular arrangement of apparatus 100, any particular apparatus 100 can support a large number of different inductor configurations or induction coil assemblies as may be required. For a particular coil main frame assembly various configurations of an induction coil assembly that can be fitted into the volume of the particular coil main frame assembly can be interchanged in the particular coil main frame assembly.

Attention is now directed to the interchangeable coating head cartridges. One or more interchangeable coating head cartridges 500 can be mounted to apparatus 100 and can be adjustably mounted to suit the requirements for a particular coating application. FIG. 2(*c*) illustrates one example of an interchangeable coating head cartridge 500 removed from apparatus 100.

The configuration and arrangement of the one or more coating head cartridges that are attached to apparatus 100 vary depending upon a particular application of the apparatus. For example the size, profile, shape, type and number of pans 501 from which the coating material is ejected or the position of head assemblies 502 and pans 501 within apparatus 100 and relative to the pipe being coated in the pipe treatment region can change, and therefore the coating head cartridge shown is exemplary. Coating head cartridge mounting system 507, which serves as the coating head mounting structure in this example, allows the radial distance between a pipe section within the pipe treatment region of apparatus 100 and the coating head cartridge to be varied by adjustment of a locating position within one or more slot 506*a* or a number of defined positions for the connection between the ends 506 of the coating head support bracket and the lever arms 505 as best seen in detail "C" in FIG. 3(*a*). The coating head cartridge mounting system in this example of the invention provides a means of adjustably mounting each one of the one or more interchangeable coating head cartridges to the coating head mounting structures relative to the radial distance from each one of the one or more interchangeable coating head cartridges to the exterior surface of the pipe in the pipe treatment region.

Figure 1A:
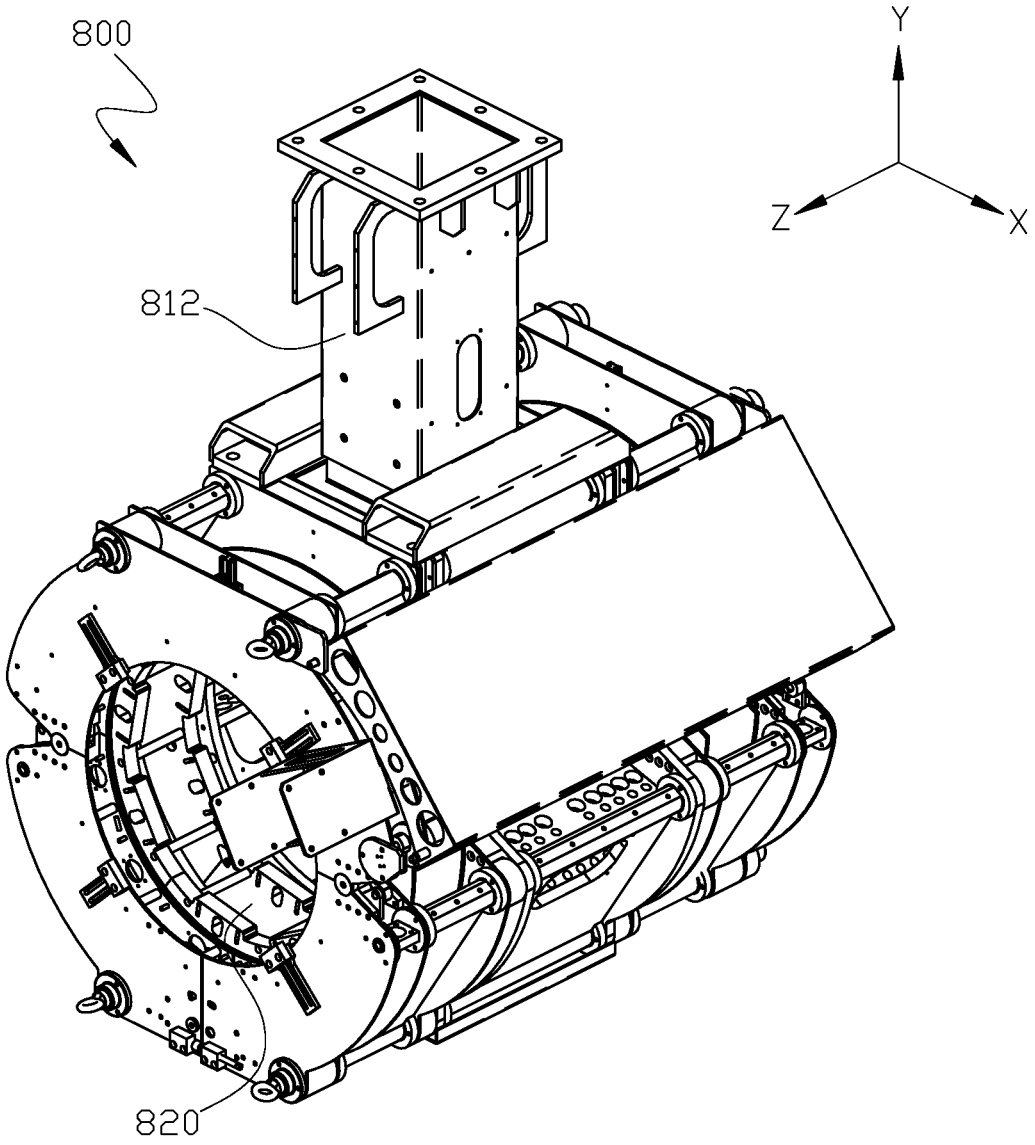
FIG. 1(a) PRIOR ART
FIG. 1(*a*) is an isometric view of a prior art combined electric induction heating and coating apparatus for the heating and coating of an exterior surface of a pipe shown in the closed position.
Figure 1B:
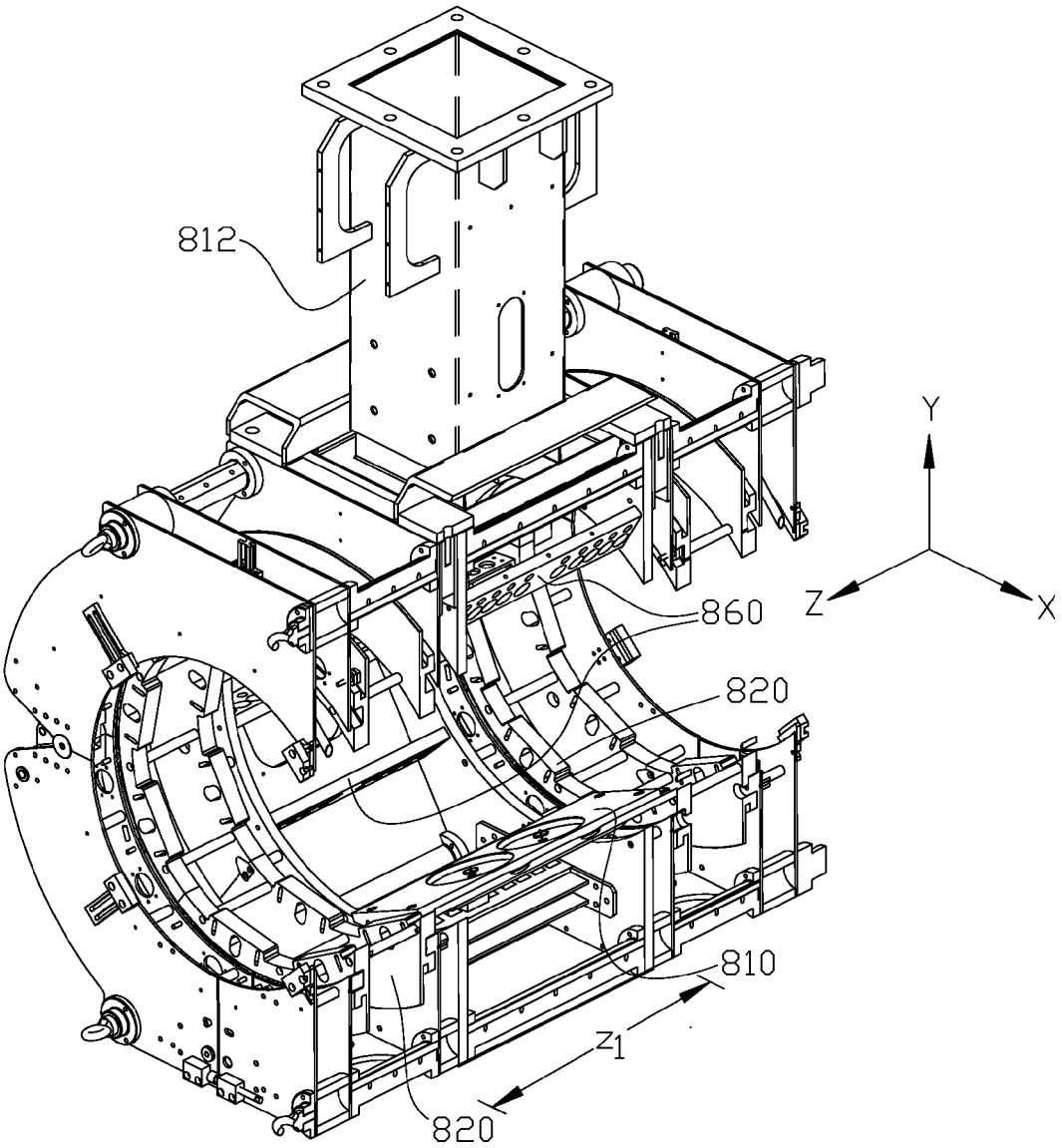
FIG. 1(b) PRIOR ART
Figure 1C:
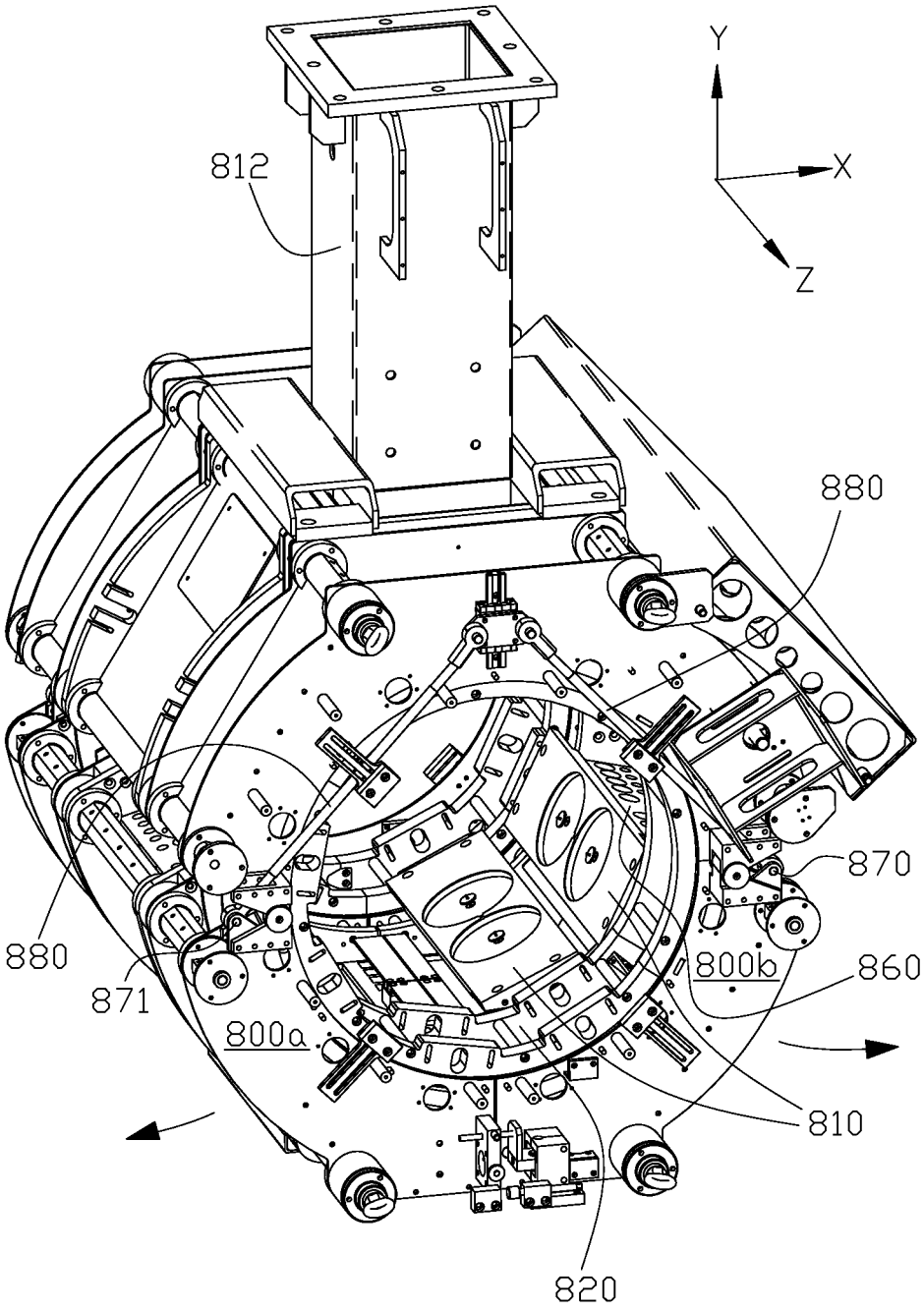
FIG. 1(c) PRIOR ART
Figure 1D:
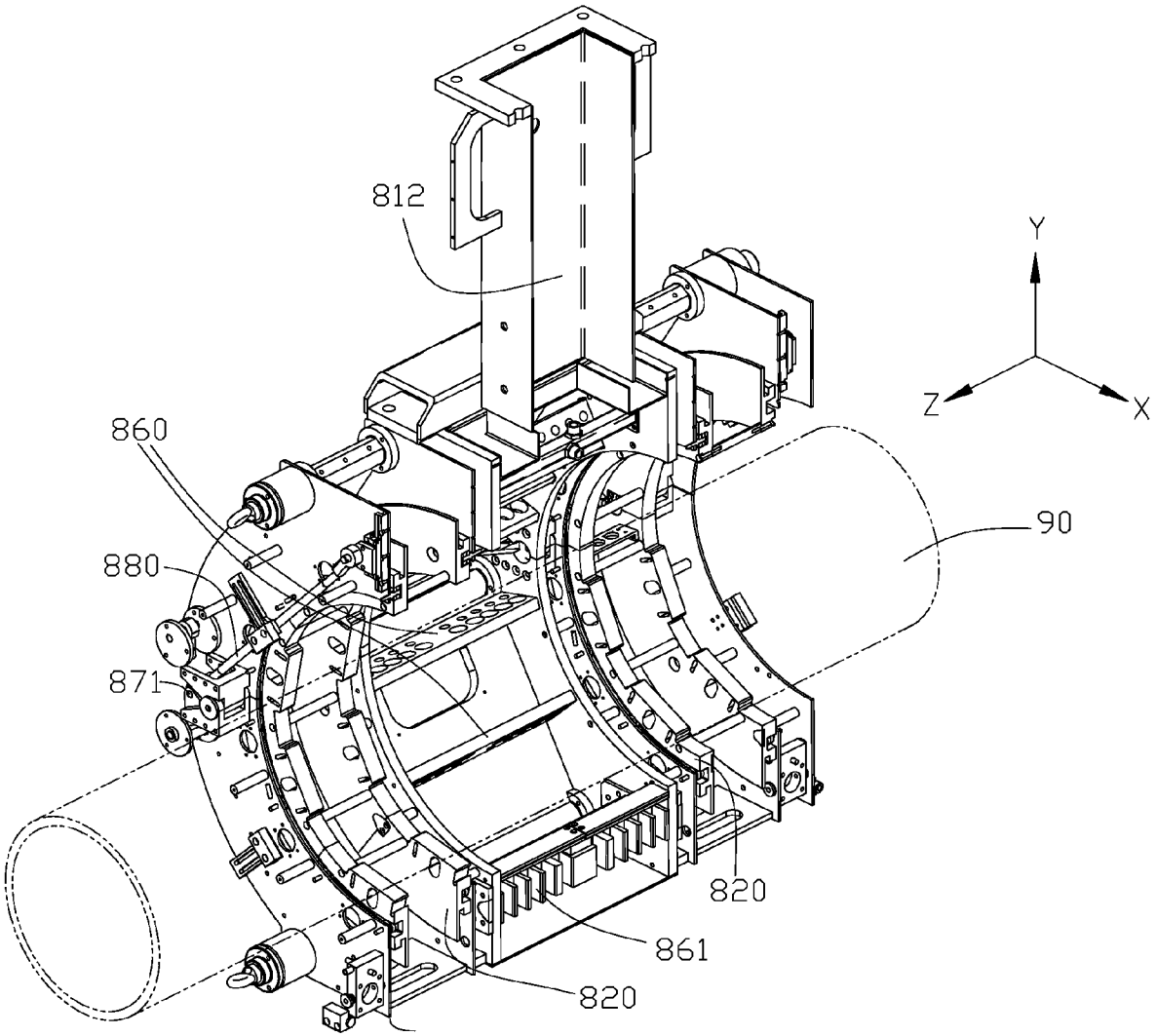
FIG. 1(d) PRIOR ART
Figure 1E:
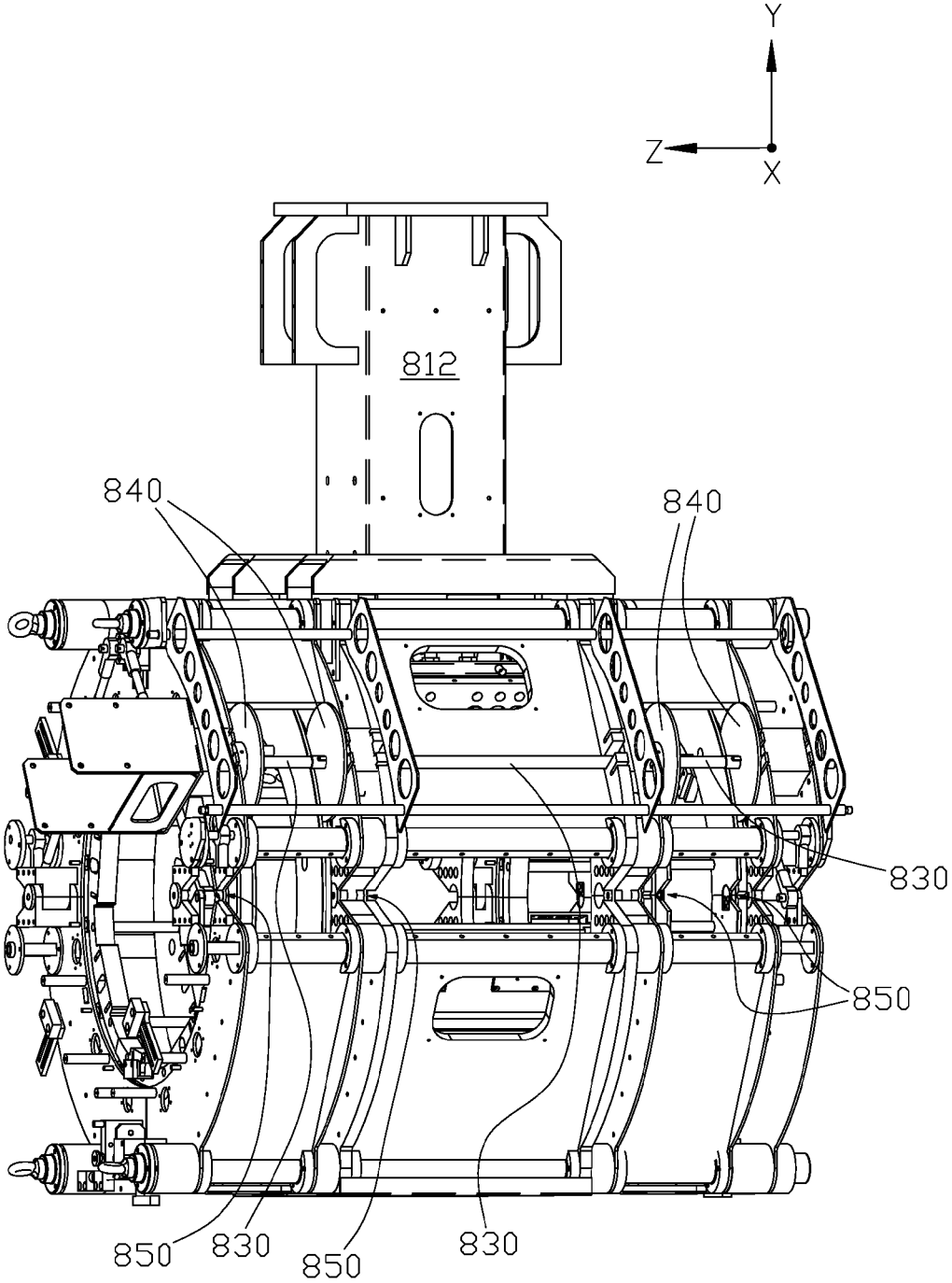
FIG. 1(e) PRIOR ART
Figure 1F:
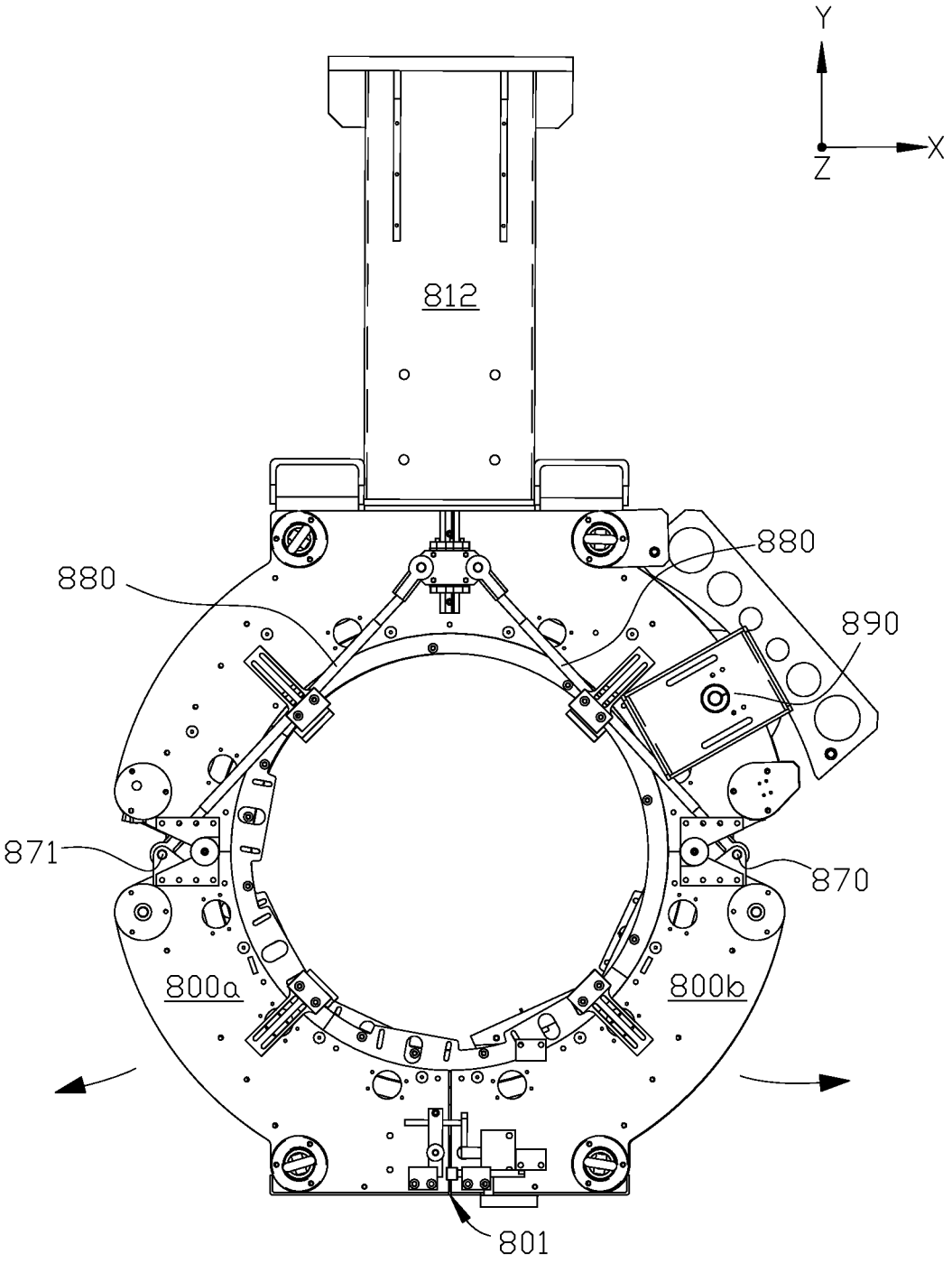
FIG. 1(f) PRIOR ART
Figure 2A:
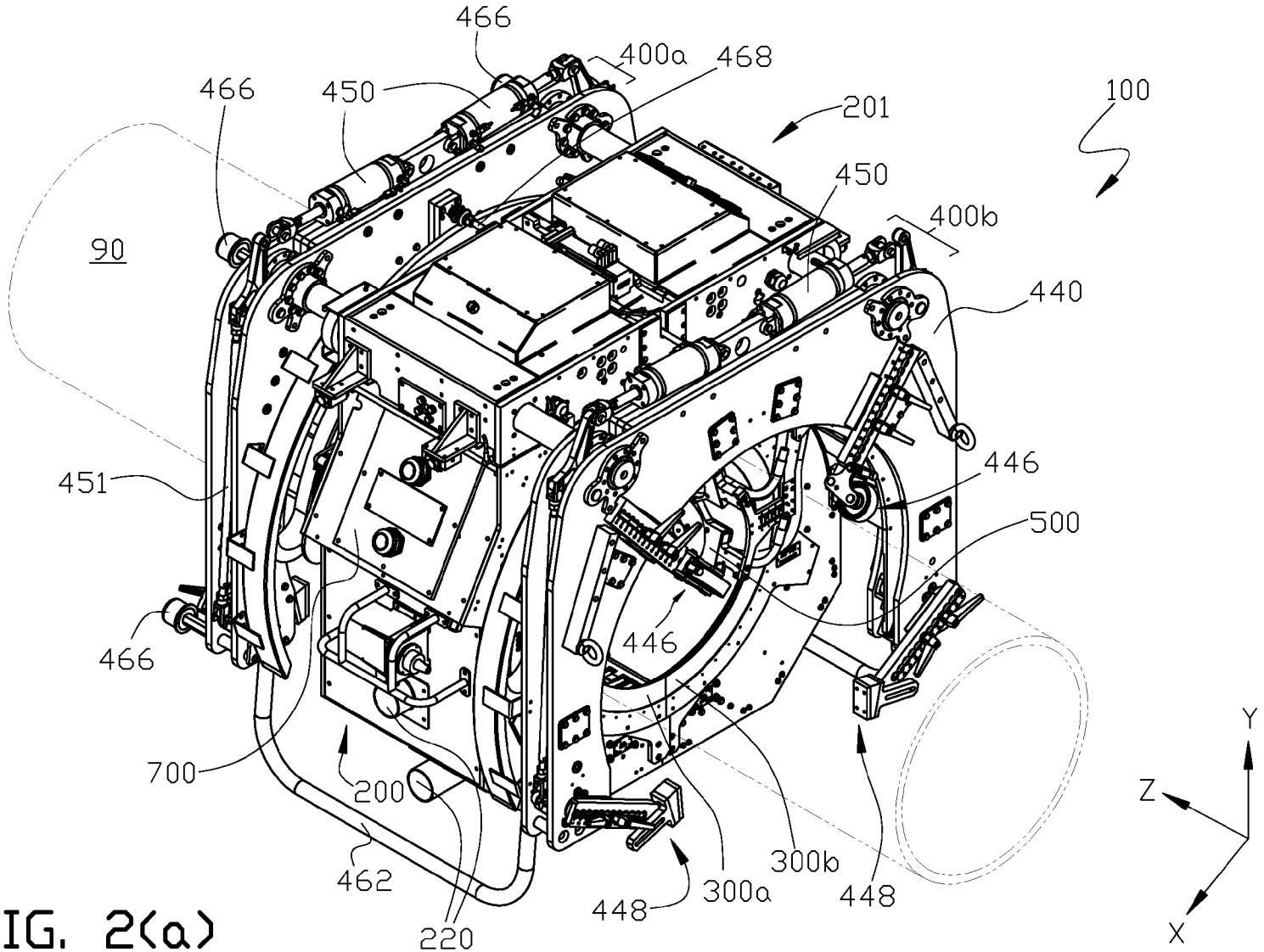
FIG. 2(*a*) is an isometric view of one example of the combined electric induction heating and coating apparatus of the present invention with one example of a removable induction coil assembly mounted in a coil assembly mounting structure of the coil main frame assembly of the apparatus, one example of an interchangeable coating head cartridge mounted in a coating head cartridge mounting frame (structure) of the apparatus, and with the apparatus in the closed position around a section of a pipe in position for induction heating and/or coating application.
Figure 2B:
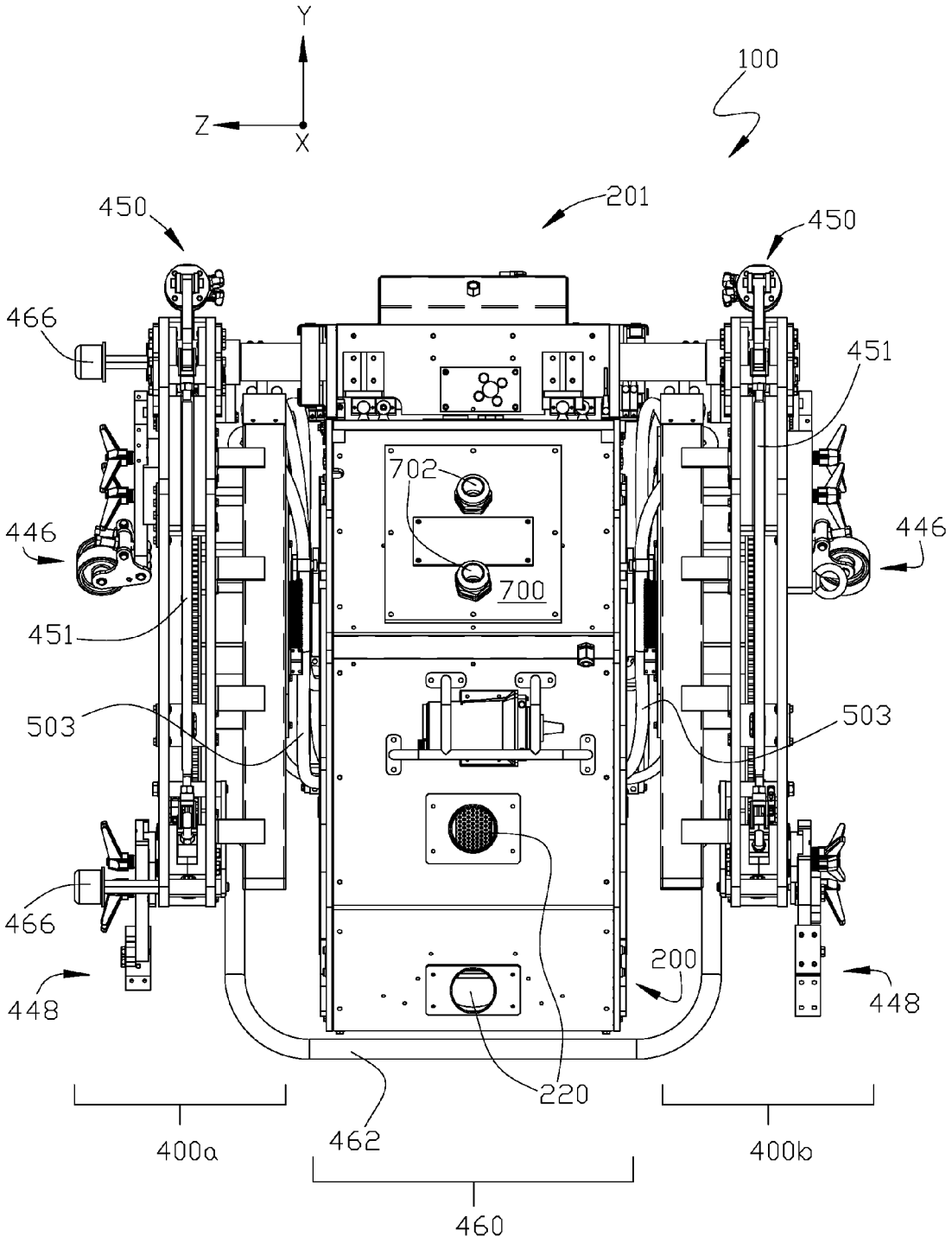
Figure 2C:
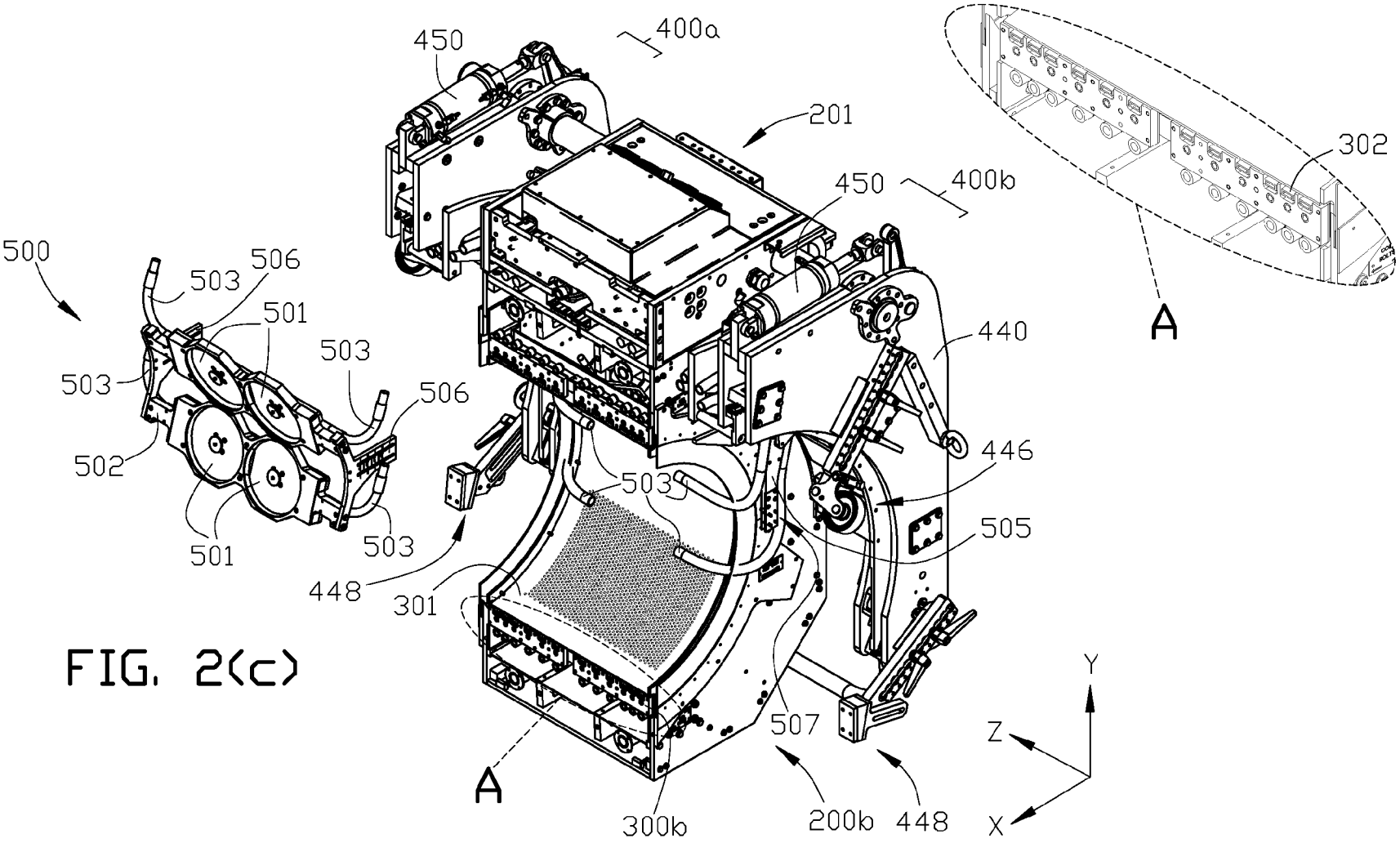
Figure 2D:
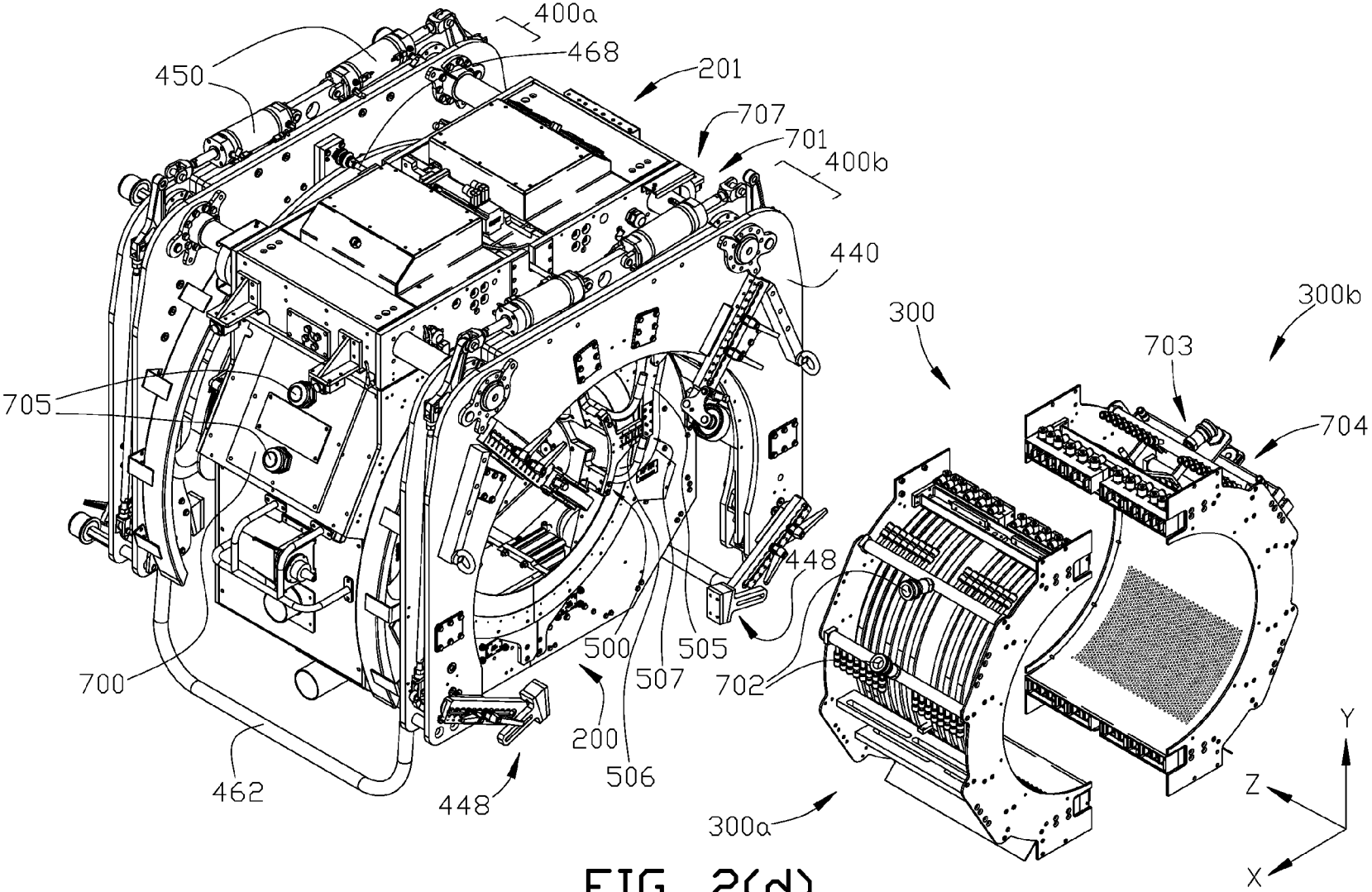
Figures 2E, 2F, 2G:
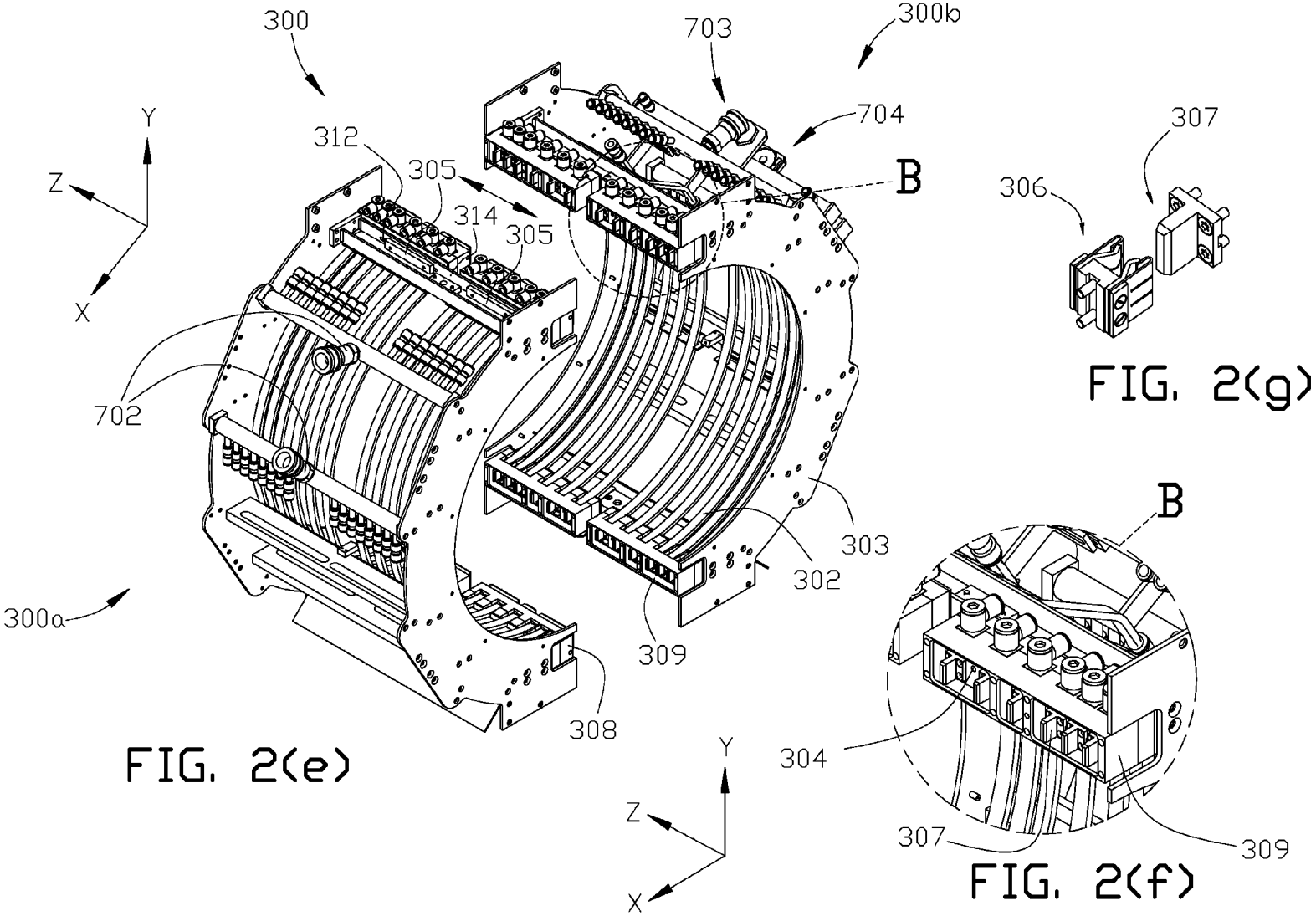
Figure 2H:
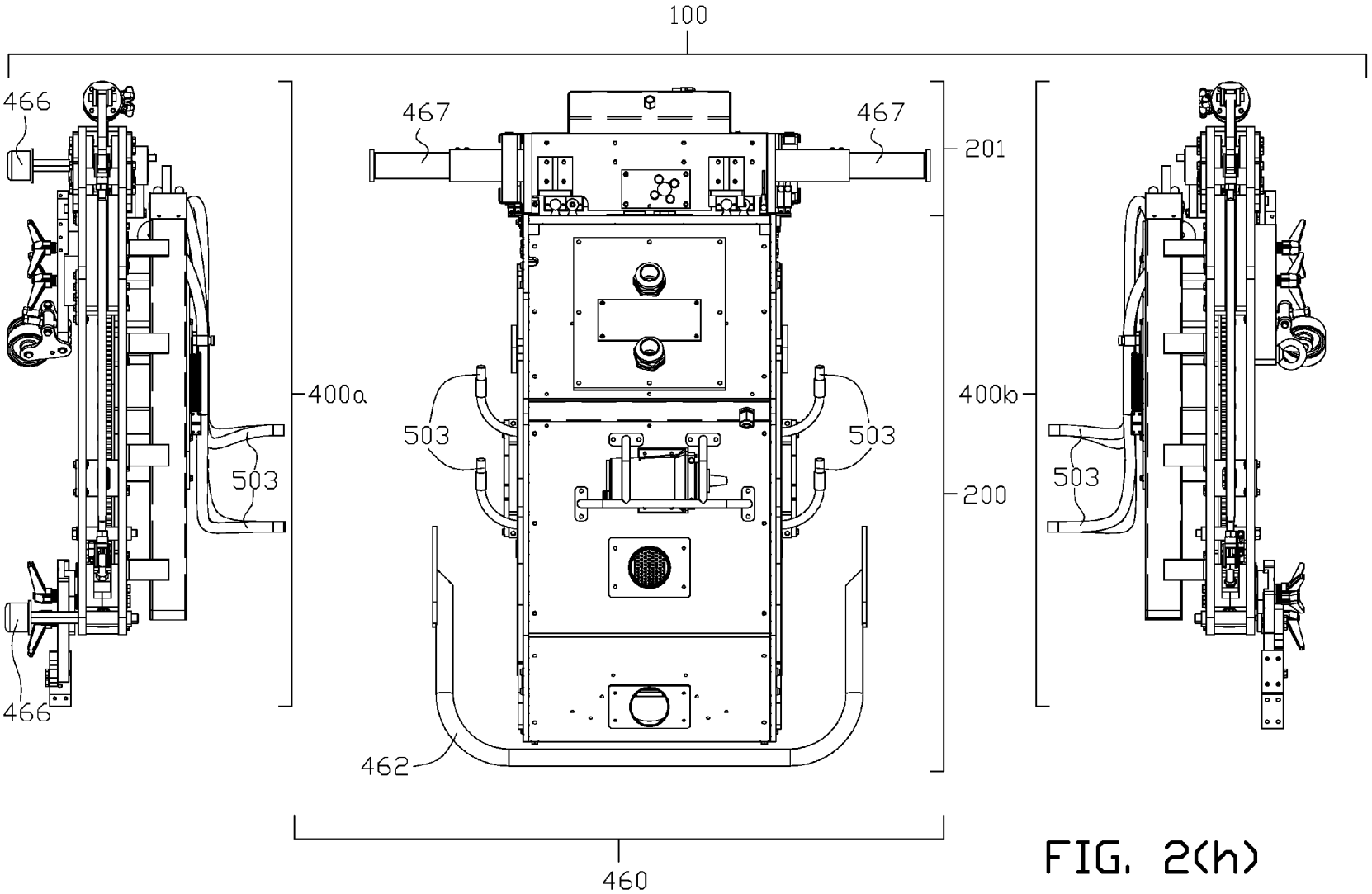
Figure 2I:
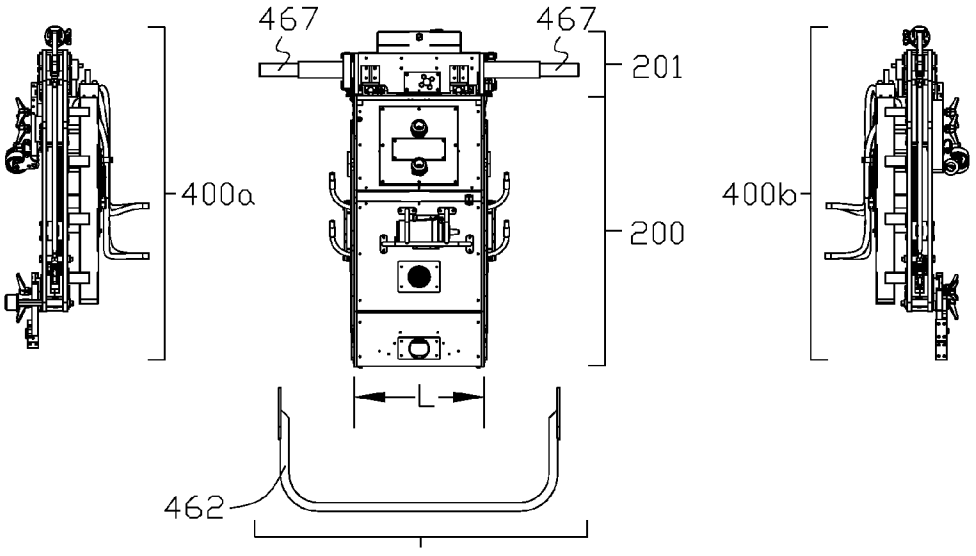
Figure 2J:
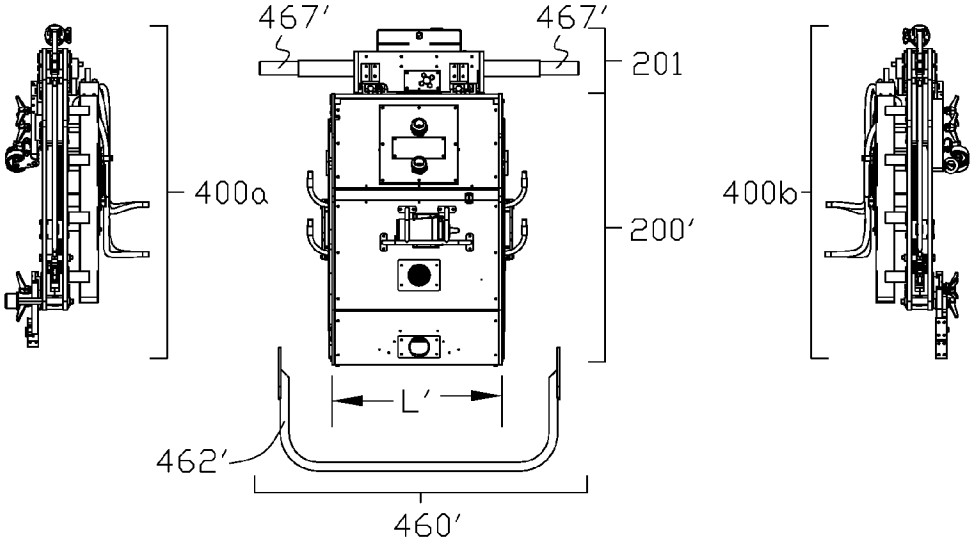
Figure 3A:
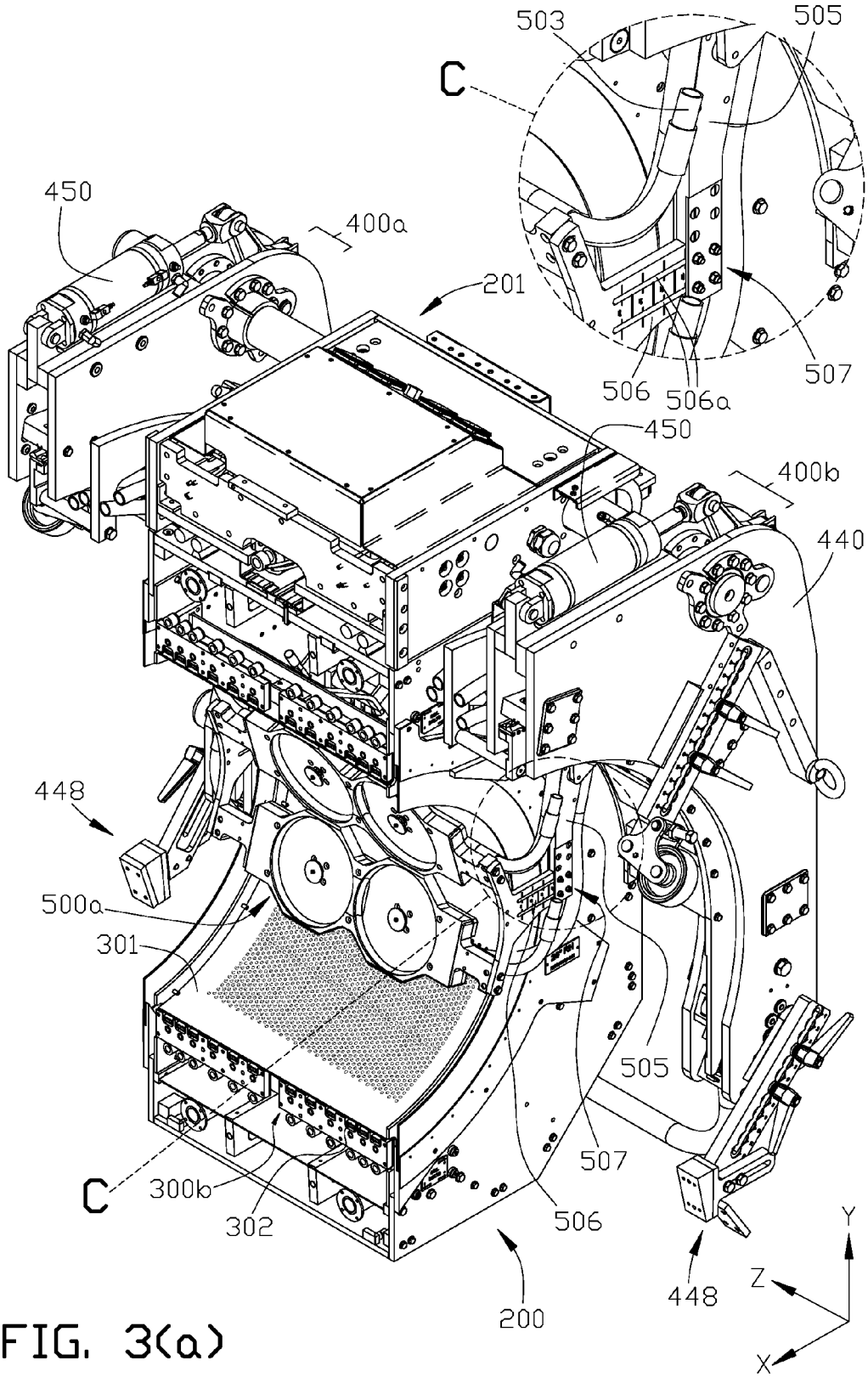
FIG. 3(*a*) is an isometric cross sectional view of the apparatus shown in FIG. 2(*a*) through a Y-Z plane and a detail view "C" of an interchangeable coating head cartridge and associated coating head mounting structure.
Figure 3B:
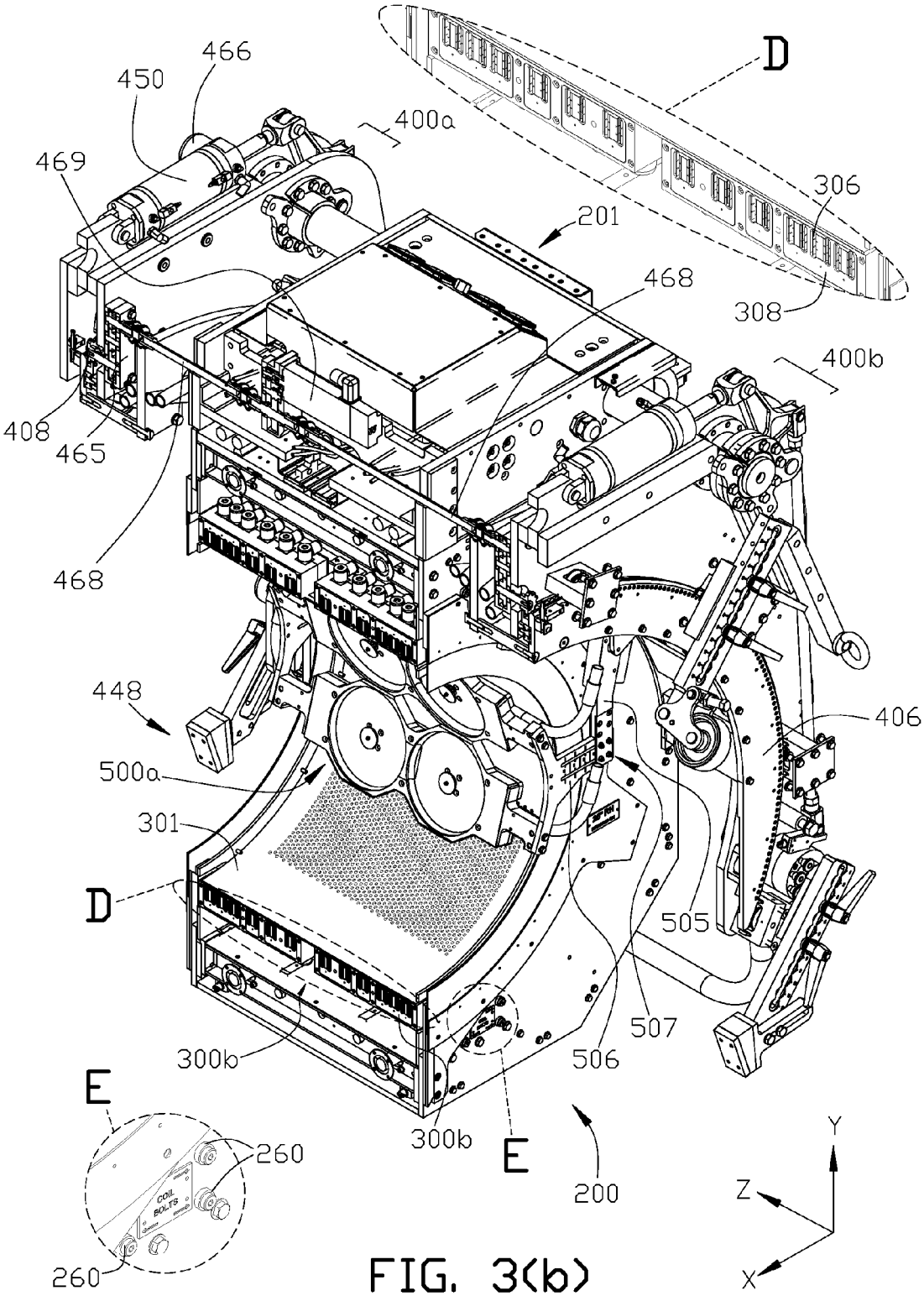
Figure 3C:
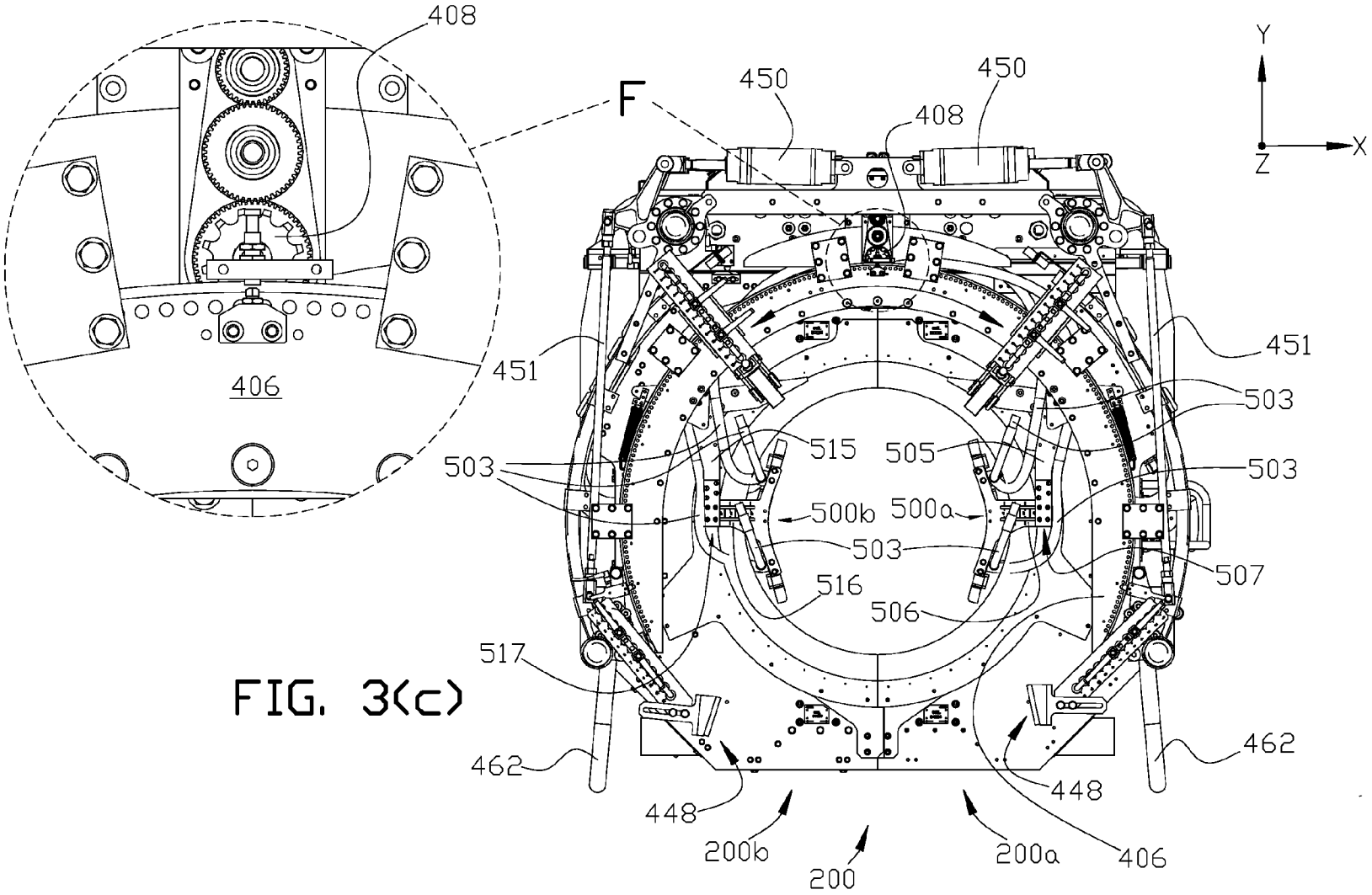

Reference is now made to FIG. 3(*a*) through FIG. 3(*c*) with respect to left and right hand side outer drive frame assemblies 400*a* and 400*b*, respectively, connected to opposing sides of central top drive frame assembly 201 and between the opposing ends of induction coil assembly 300 that may be mounted in coil main frame assembly 200. Left hand side outer drive frame assembly 400*a* is generally a mirror image in installation and operation of right hand side outer drive frame assembly 400*b* and operates accordingly in synchronization with the right hand side outer drive frame assembly. Therefore only right hand (first) side outer drive frame assembly 400*b* is discussed here in detail, with it being understood that the left hand (second) side outer drive assembly components operate (with consideration of the mirror image arrangement) in similar manner as the described components of the right hand side outer drive frame assembly. Each outer drive frame assembly is "saddle-shaped" with an open bottom as shown in the figures to fit over and around the sides of a pipe being treated in the pipe treatment region of the coil main frame assembly.

In FIG. 3(*a*) and FIG. 3(*b*) the coil turns or inductors 302 housed in induction coil assembly half 300*b* shown in these figures, when mated with the inductors in induction coil assembly half 300*a* as described above, forms an electric induction heating circuit, that in this example is a solenoidal induction coil, around the circumference of the closed opening forming a pipe treatment region of the coil main frame assembly 200 when the coil main frame assembly is in the closed coil main frame assembly position. One or more coating head cartridges 500*a* and 500*b*, which are exemplary embodiments of the coating head cartridge 500 (consisting of four pans 501 within two coating head cartridges in this example), are located interior to the formed solenoidal induction coil in the pipe treatment region as shown in these figures. A protective cover plate 301 can be used to separate the formed solenoidal coil from the coating head cartridge(s). The protective cover plate is shown with an array of vent holes to facilitate forced vacuum extraction of loose coating material from the pipe treatment region during processing via extraction ducts 220 shown by example in FIG. 2(*a*) through FIG. 2(*c*) and located in either or both halves of coil main frame assembly 200. When alternating current is supplied to the formed solenoidal coil by suitable means from a power source not shown in the figures (via power port 704) and external to apparatus 100, the generated magnetic flux penetrates the section of pipe positioned in the enclosed opening of apparatus 100 that forms the pipe treatment region to inductively heat the pipe section, either prior or subsequent to a coating application, or for other reason as required with or without coating. Materials used in apparatus 100 located between the outer diameter of the pipe and the formed induction coil within the closed section (including cover plate 301, if used, and coating head cartridges 500*a* and 500*b*, if used) are generally formed from non-electrically conductive materials, or otherwise formed to minimize induced heating of the materials. A coating material can be supplied to the coating head pans in the coating head cartridge(s) through pipes 503 via the outer drive frame assemblies, as seen in FIG. 2(*c*) and via coating supply apparatus and method known in the art.

Figure 4A:
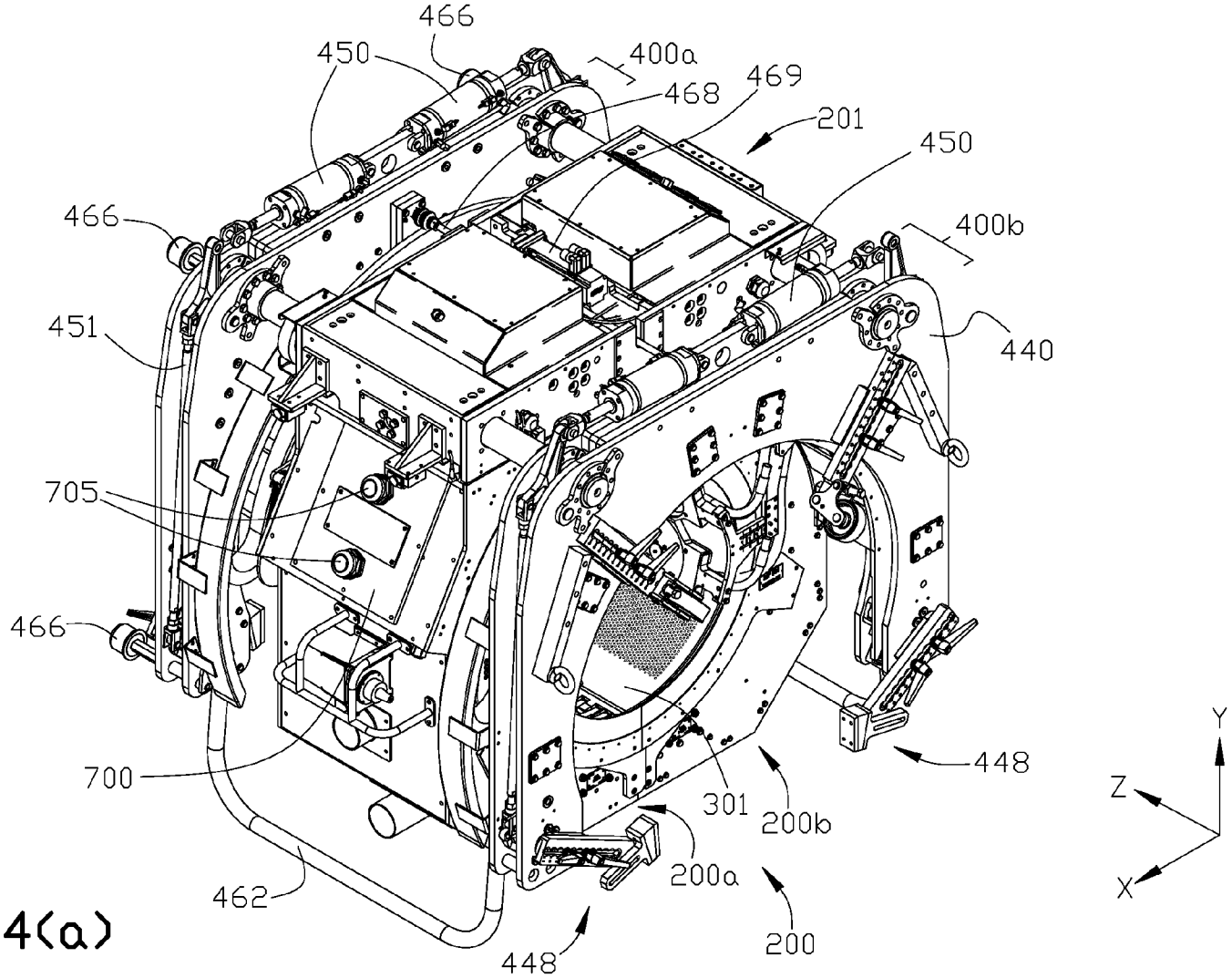
FIG. 4(*a*) is an isometric view of the apparatus shown in FIG. 2(*a*) in the closed position when the closed coil main frame assembly forms a pipe treatment region.
Figure 4B:
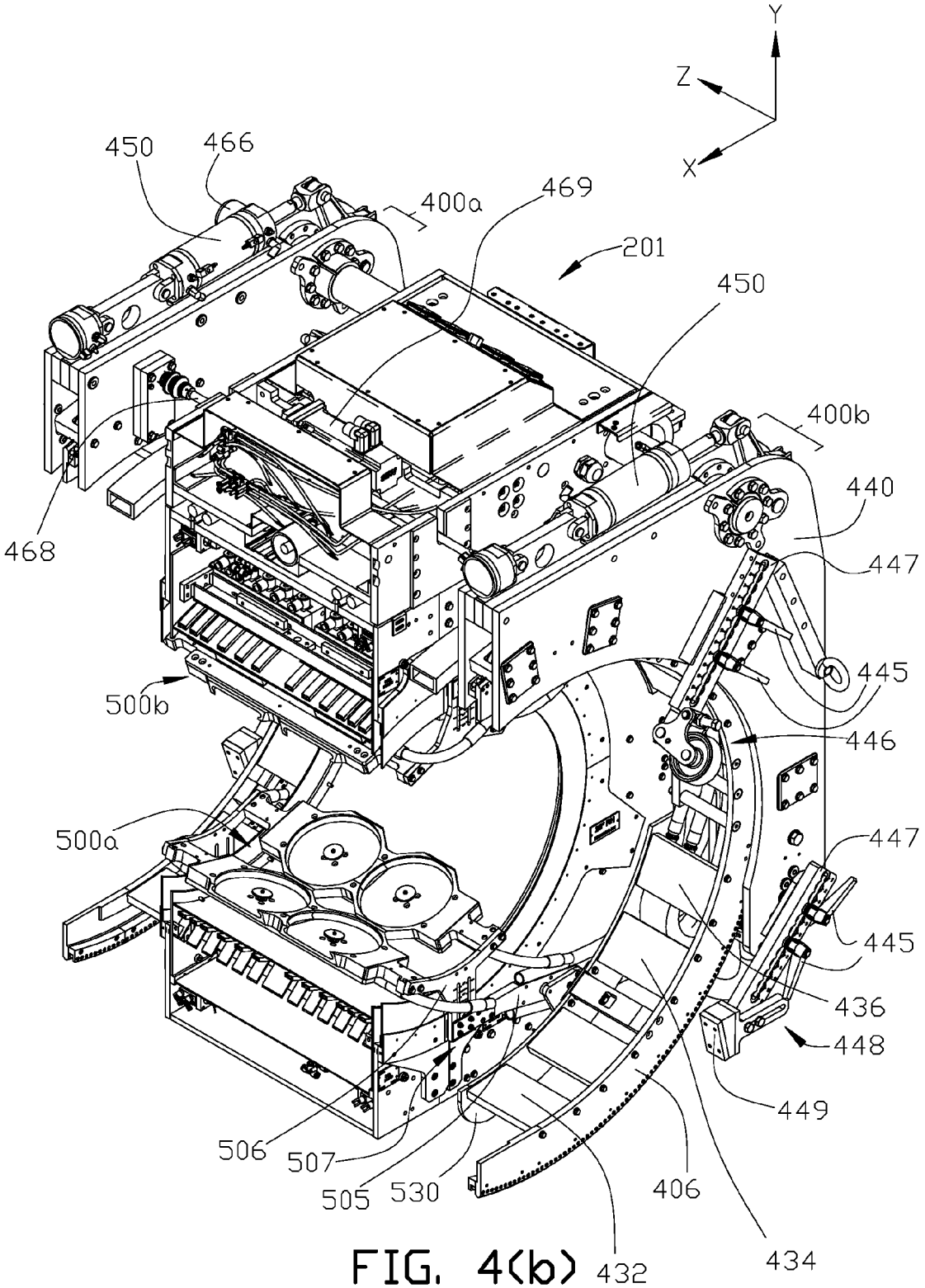
Figure 4C:
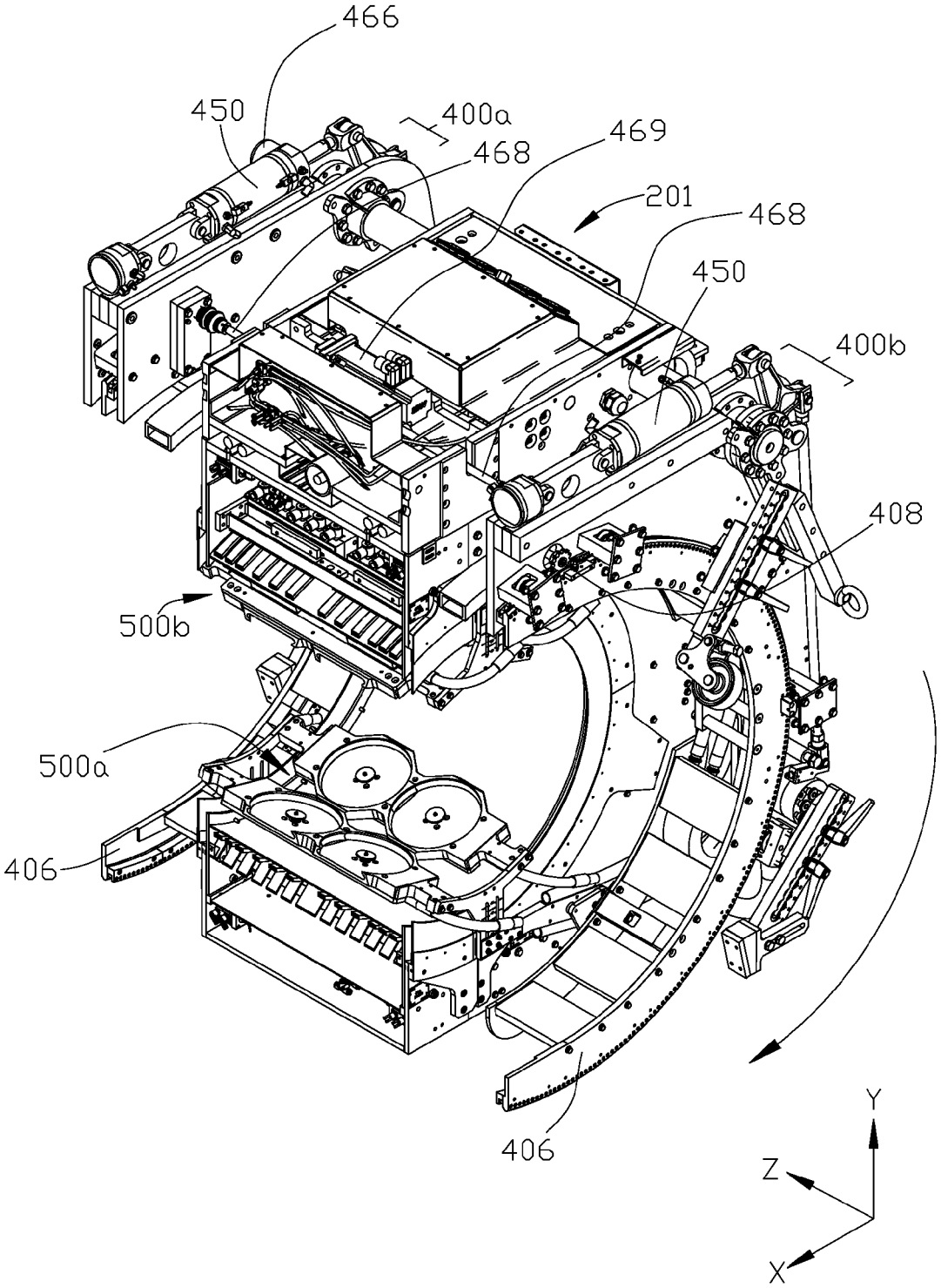

As seen in FIG. 3(*a*) through FIG. 3(*c*), lever arm 505 is attached at a first end to coating head support bracket 506 and attached, by means of a spring loaded actuator at a second opposing end of lever arm 505 to a first end of standoff frame 530, which standoff frame is attached at a second opposing end of the standoff frame to arcuate rack 406 as best seen in FIG. 4(*b*). The spring loaded mechanism is activated to position the coating head cartridge assemblies 502 relative to the external pipe surface when the coil main frame assembly closes, by action of a cam and pin pulling on the spring, such that the coating head cartridge assemblies are axially projected close to the pipe surface to a coating process position when coating the pipe in the pipe treatment region. Similarly it is deactivated when the coil main frame assembly opens as the pin releases the cam and consequently the spring is un-tensioned, such that the coating head cartridge assemblies 502 move axially away from the pipe to a retracted coating head position. Hoses or pipes delivering the coating material to the coating head cartridge assemblies 502 are located in a space frame arrangement mounted to arcuate rack 406. The space frame arrangement comprises support plates and brackets 432, 434, and 436. Drive pinion 408 is shown in this example with suitable gearbox 465 powered driver in FIG. 3(*b*) and FIG. 3(*c*) and may be belt, direct cog, chain, or otherwise driven in other examples of the invention. The drive pinion 408 engages arcuate rack 406 to rotate the rack (in either the clockwise or counter clockwise direction as indicated by the arrows in FIG. 3(*c*)) about the longitudinal axis of a pipe section positioned within the closed apparatus 100. As described above the spring loaded mechanism provides a means for positioning the one or more interchangeable coating head cartridges mounted to the coating head mounting structure relative to the radial distance from each one of the one or more interchangeable coating head cartridges to the exterior surface of the pipe in the pipe treatment region to a coating process position at least when the coil main frame assembly is in the closed coil main frame assembly position and to a retracted coating head position at least when the coil main frame assembly is in the opened coil main frame position.

As described above the coating head mounting structure to which each of the one or more coating head cartridges are attached to are located in the right (and left) side outer drive frame assemblies along with the coating head cartridge positioning components and coating head drive assemblies that rotate the one or more coating head cartridges around the exterior of the pipe in the pipe treatment region when the coating head drive assemblies are connected to the coating system driver in the central top drive frame assembly.

Although not shown in this example an alternative embodiment of the invention can use a linear actuator mounted on arcuate rack 406 that has its output pivotally attached via a pivot arm to the second end of standoff frame 530 to assist in proper positioning and engagement of the coating head cartridge assemblies relative to the surface of the pipe and allow correct rotation around the outer diameter of the pipe within the pipe treatment region during the coating process to ensure delivery of coating material to the pipe surface, and thus function as an alternate or an additional means for positioning the one or more interchangeable coating head cartridges mounted to the coating head mounting structure relative to the radial distance from each one of the one or more interchangeable coating head cartridges to the exterior surface of the pipe in the pipe treatment region to a coating process position at least when the coil main frame assembly is in the closed coil main frame assembly position and to a retracted coating head.

Referring to FIG. 3(*c*) in this particular example of the invention two coating head cartridges on either side of a pipe within the pipe treatment region, namely coating head cartridges 500*a* and 500*b* are used. Components (coating head cartridge mounting system 517 comprising coating head support bracket 516 and lever arm 515) associated with the second coating head cartridge 500*b* are located as shown in the drawings and function similarly to correspondingly identified components (coating head cartridge mounting system 507, comprising coating head support bracket 506 and lever arm 505) associated with first coating head cartridge 500*a*. In this non-limiting example the arrangement of the two coating head cartridges, the arcuate rack 406 and associated components are arranged to allow at least 180 degrees rotation of a coating head cartridge around the outer circumference of a pipe section in the pipe treatment region within the apparatus 100 when the coil main frame assembly is in the closed position, preferably with some overlap to ensure coating of the entire circumference of the pipe section as diagrammatically illustrated in FIG. 7(*b*) with coating head cartridges 500*c*.

Figure 7C:
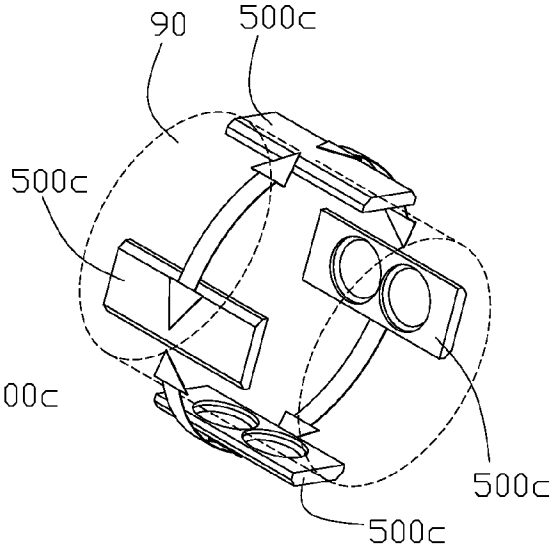
FIG. 7(*a*) through FIG. 7(*c*) diagrammatically illustrate examples of the variation of rotation angle and variability of coating head cartridges that rotate around the exterior surface of a pipe in the pipe treatment region in alternate examples of apparatus and method of the invention.
Figure 7B:
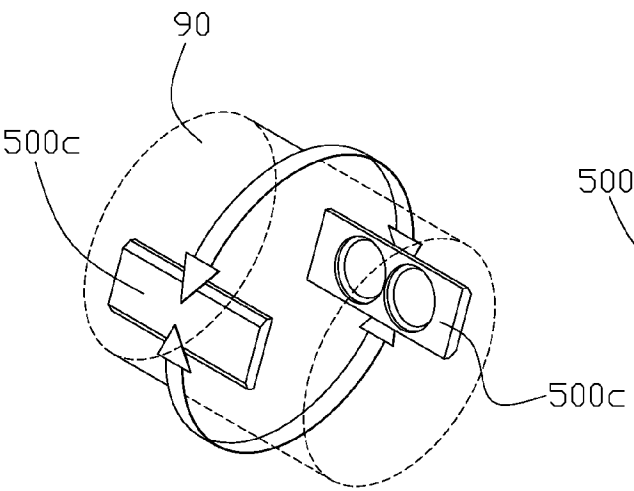
Figure 7A:
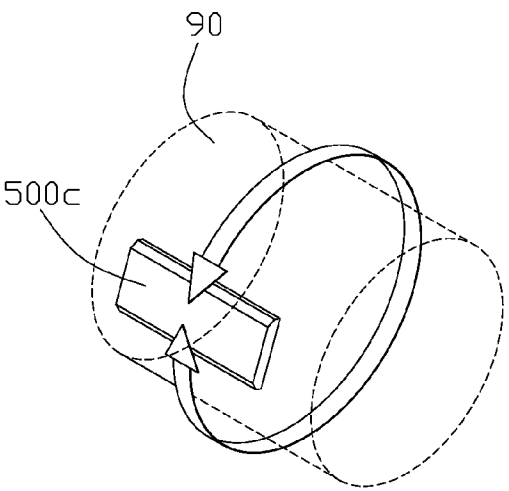

In other examples of the invention, the rotation can be a full 360 degrees, plus a variable overlap or over rotation of significant degrees, limited only by specific mechanical design; in this instance one coating head cartridge 500*c* can be used and a full rotation around the pipe 90 in the pipe treatment region is encountered as diagrammatically illustrated in FIG. 7(*a*). A third example is shown in FIG. 7(*c*) where four coating head cartridges 500*c* are used and each of the four coating head cartridges covers 45 degrees of rotation with appropriate overlap as required in a particular application. Other rotational combinations of the number of coating head cartridges and arc coverage of a coating head cartridge around the pipe can be used as appropriate for a particular application.

Also optionally and adjustably attached to the outer (outboard) end plate 440 of left hand side outer drive frame assembly 400*a* (and equally right hand side outer drive frame assembly 400*b*), are adjustable upper pipe rollers 446, which serve as one type of apparatus entry and exit pipe positioning means, and lower pipe tensioners 448, which serve as one type of apparatus entry and exit pipe tensioning means, that may be positioned, for example, by linear actuators 450 and connecting linkages 451 shown in the figures; in other examples of the invention pipe rollers and/or tensioners may be mounted to other suitable structural elements to assist in centering the apparatus 100 within the pipe section with the closed apparatus when the coil main frame assembly is in the coil main frame assembly closed position. The use, quantity and location of pipe rollers or pipe tensioners depends on the particular application of the invention and such factors as the size of the pipe being treated; the special orientation of the pipe and apparatus 100 as further described below; the coating material being applied on pipe; and other operating parameters.

Figure 8A:
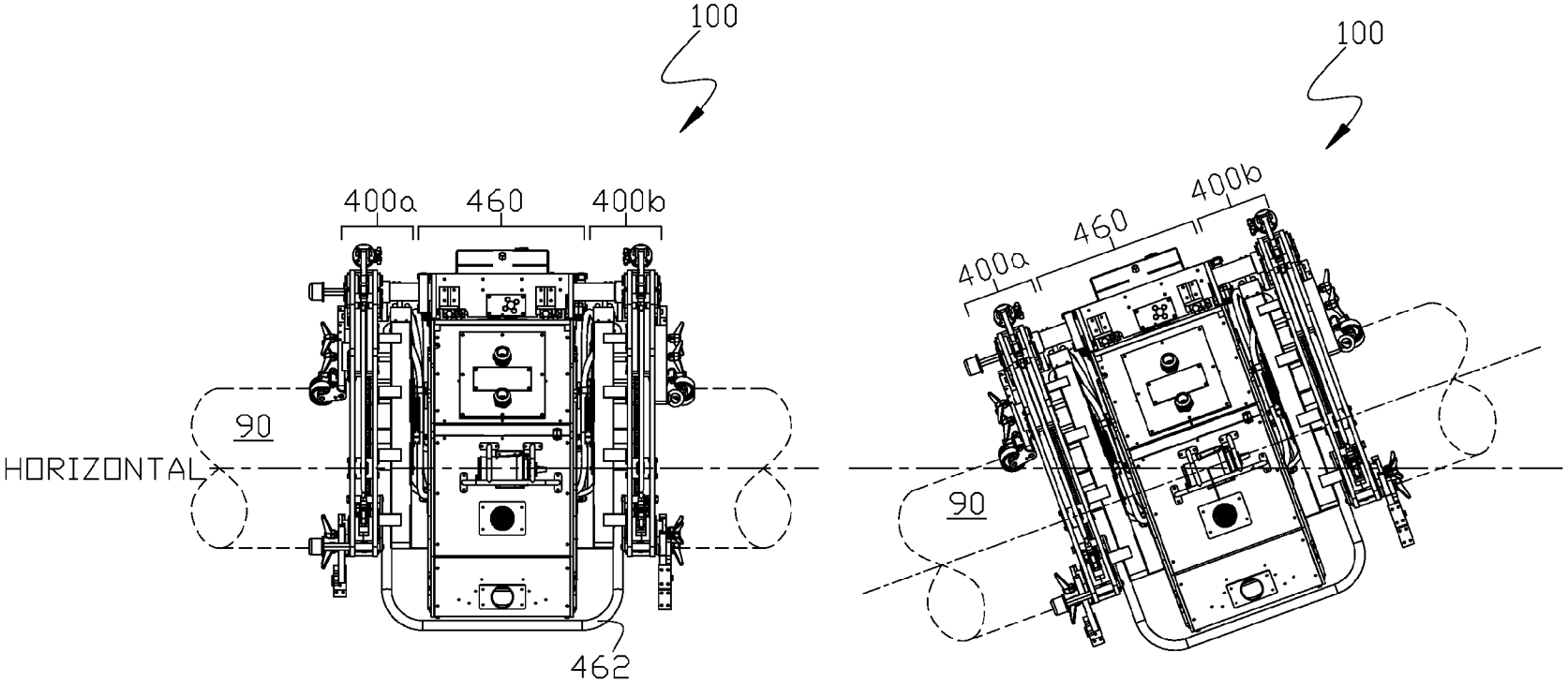
FIGS. 8(*a*) and 8(*b*) are views of the apparatus in FIG. 2(*a*) mounted to a pipe in both vertical and horizontal modes and displaced/offset pipe angles.
Figure 8B:
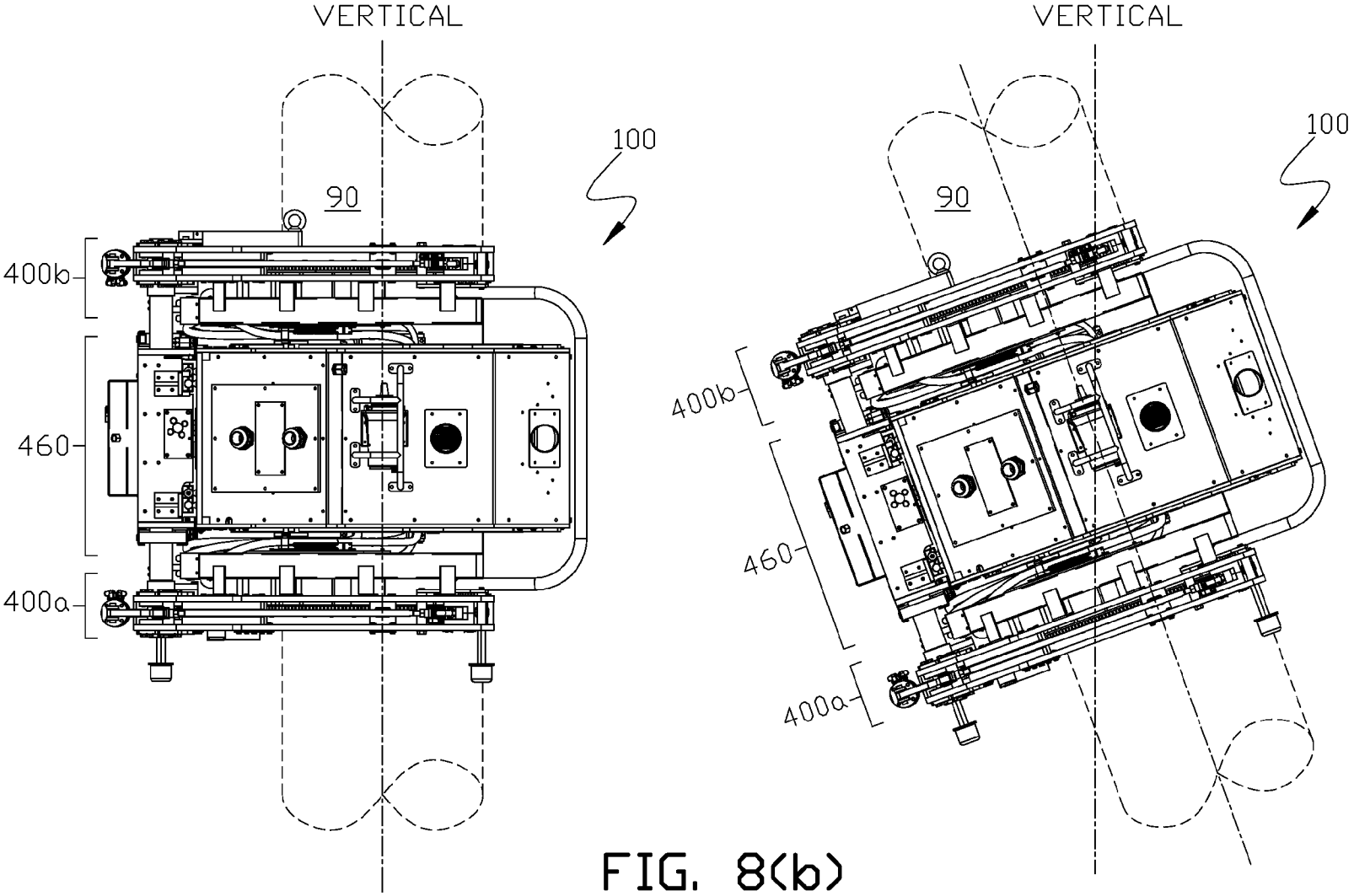
Figure 9A:
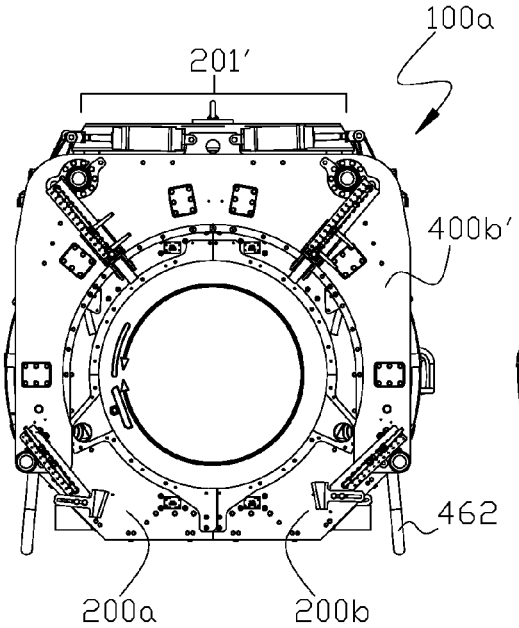
FIG. 9(*a*) through FIG. 9(*d*) are diagrammatic representations illustrating the use of the apparatus without an induction coil assembly mounted in the coil main frame assembly, and using inductors or induction coils, and/or coating heads mounted in varying configurations around the periphery of the arcuate rack of the coating head drive assembly to rotate both the inductors and coating heads around the exterior surface of the pipe in the pipe treatment region.
Figure 9B:
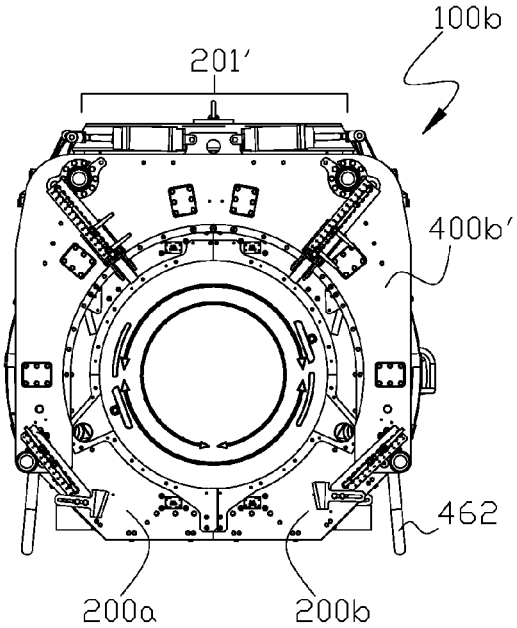
Figure 9C:
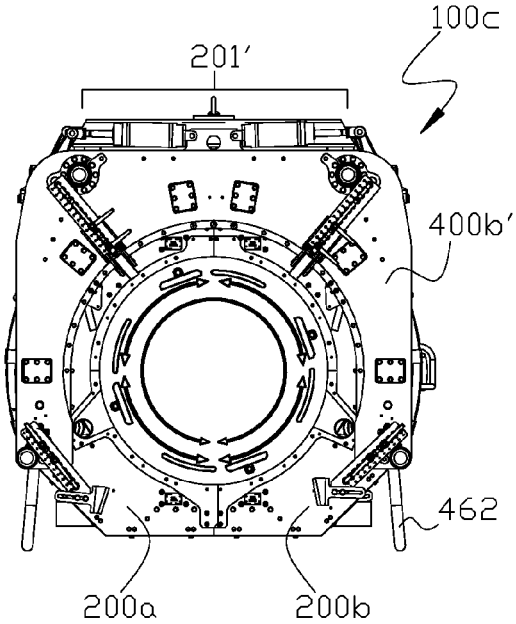
Figure 9D:
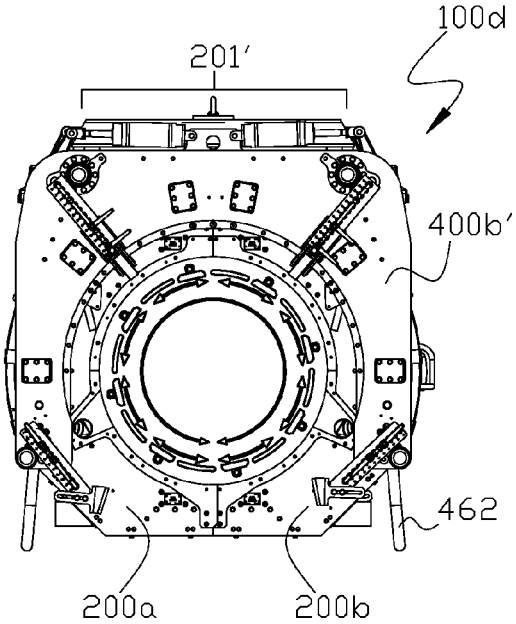

Apparatus 100 as a whole may be used in applications horizontally as depicted in FIG. 8(*a*). In this instance apparatus 100 is typically suspended above and lowered onto the pipe before engaging the pipe using lower pipe tensioners 448 and upper pipe rollers 446. Where the pipe application is offset from horizontal by some degrees, as is practically found in the field, the apparatus can maintain position on the pipe by use of alternative upper pipe positioning tooling pads, in place of the upper rollers which are similar in design to the lower tensioner pads 449 in FIG. 4(*b*) and in conjunction with them provide a degree of grip to the positioning of the apparatus relative to the pipe in both the X and Z indicated planes. Thus the positioning tool pads are another example of pipe tensioning means.

The positions of the lower pipe tensioners 448, with pads 449 and upper pipe rollers, with or without pads, can be adjusted by means of the cam locking release screws 445 and slotted support bars 447, to suit the diameter of the pipe to be treated in the pipe treatment region of apparatus 100.

As shown in FIG. 8(*b*), equally in a vertical plane and at any practically required angle from vertical, apparatus 100 may be moved to and around the pipe and held in position relative to the axis of the pipe by an external device, or manipulator, as known in the art. In this embodiment the tensioners 448 and rollers 446 are not typically engaged but can be used if necessary in a particular application.

As illustrated in FIG. 4(*a*) through FIG. 4(*c*), in this example of the invention when drive pinion 408 rotates arcuate rack 406 in the clockwise direction as illustrated by the arrow in FIG. 4(*c*) first coating head cartridge 500*a* rotates from a 90 degrees position to a 180 degrees position (shown in FIG. 4(*c*) in a X-Y plane) around the outer circumference of a pipe section to be treated in the pipe treatment region within the closed opening of apparatus 100.

Drive pinions 408 in each of the left and right hand side outer drive frame assemblies are driven, by a suitable coating system driver means, such as an electric motor, servomotor 469 or other rotational driver, internally or externally geared and housed within the central top drive frame assembly 201. Drive rods 468 connect the coating system driver in the central top drive frame assembly to the drive pinions in each outer drive frame assembly either directly or via a suitable gearbox 465 arrangement as described above.

Use of an intelligent control means for rotational control, such as servo control, gives the possibility of highly accurate and variable positioning, speed control, acceleration and deceleration control, speed variation and control/variation of the rotation angle and hence the application of any coating material.

When these features of apparatus control are co joined with the known art of varying supplied coating material volume, density and flow rate, as well as when they are not, it can provide almost infinitely varied and controlled coating application as required.

One example application of use of this control capability allows the application of coating material to the pipe to be more uniformly distributed. Particularly so in areas where traditional means results in over or under thickness, for example at overlap or underlap positions.

Figure 5A:
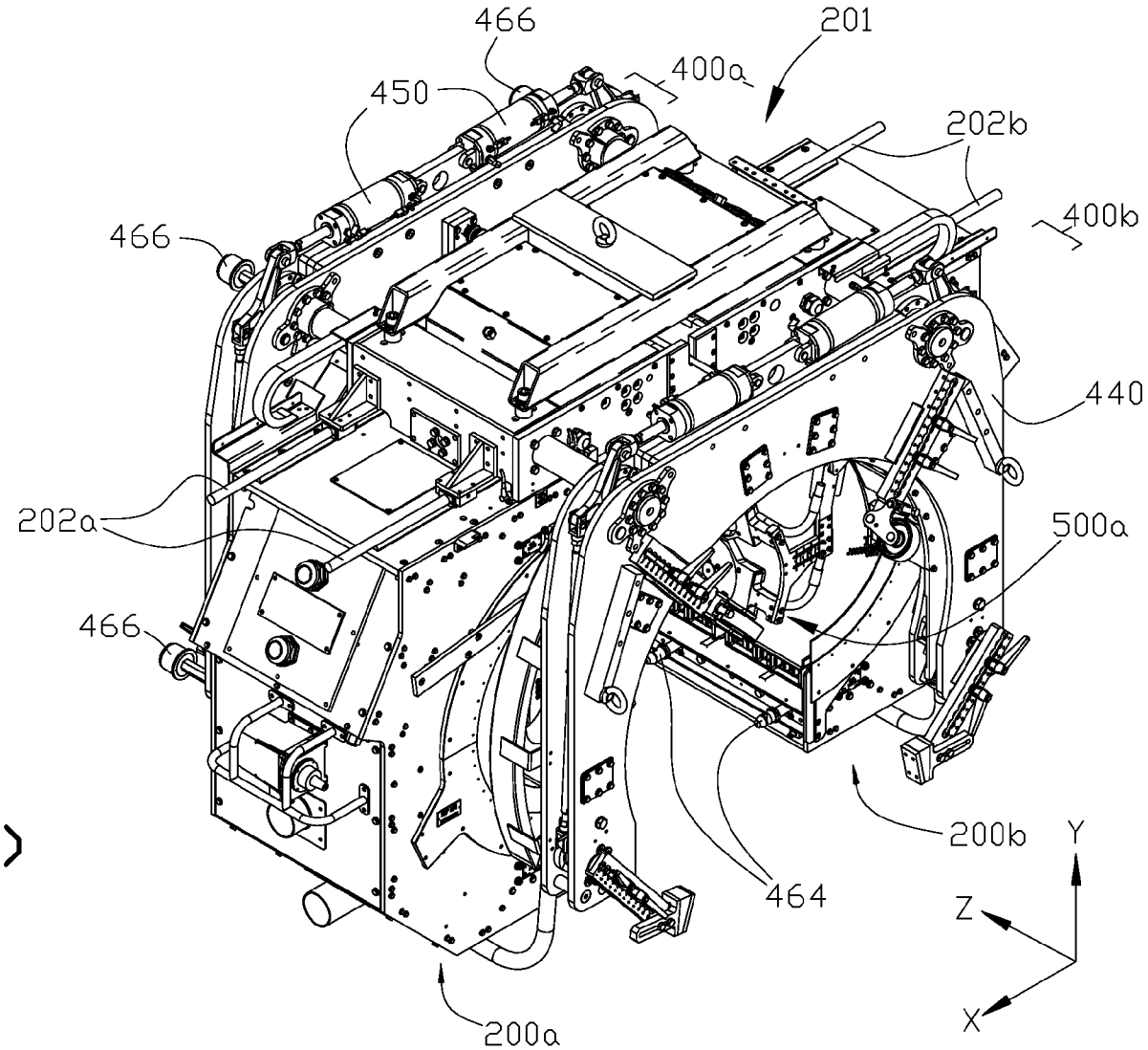
FIG. 5(*a*) is an isometric view of the apparatus shown in FIG. 2(*a*) in the opened position where the coil main frame assembly forms an opening for the entry or exit of an axial section of a pipe to or from the pipe treatment region and the coating head cartridge positioned as shown in FIG. 3(*a*), FIG. 3(*b*), FIG. 3(*c*) and FIG. 4(*a*).
Figure 5C:
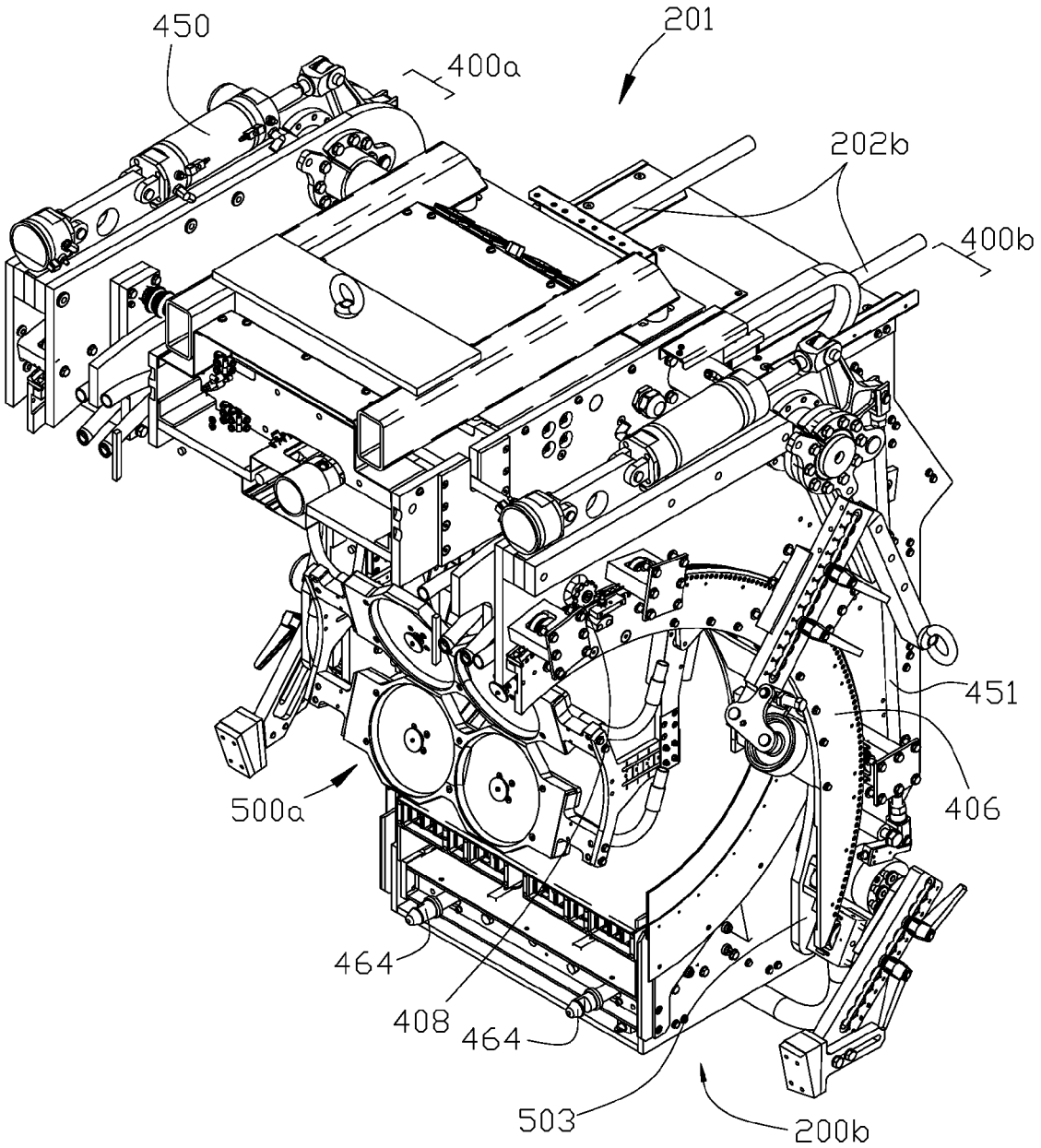
Figure 5C:
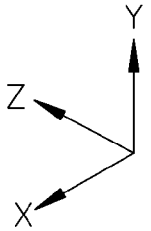

Upon completion of the coating and/or the heating process around a pipe section in the pipe treatment region, apparatus 100 may either be moved along the axial length of the pipe, using upper pipe rollers 446 if fitted, while still in the closed position; or apparatus 100 can transition to the opened position shown in FIG. 5(*a*) through FIG. 5(*c*).

Central top drive frame assembly 201 contains a coil main frame assembly driver system for moving the coil main frame assembly 200 between a closed coil main frame assembly position when the coil main frame assembly forms an encircling closed coil main frame assembly around an axial section of the pipe in a pipe treatment region (closed position of apparatus 100) and an opened coil main frame assembly position when the coil main frame assembly forms an opening for the entry or exit of the axial section of the pipe to or from the pipe treatment region (opened position of the apparatus 100). One means for transitioning the coil main frame assembly frame 200 from the closed to the opened position as shown in FIG. 6(*a*) and FIG. 6(*b*) are transverse linear slide bearings 202 and transverse linear actuators 203*a* and 203*b* located in the central top drive frame assembly. Pneumatic control valves apply or remove air to transverse linear actuators (cylinders) 203*a* and 203*b* that are back mounted to the central top drive frame assembly 201. The front actuator arms 203*a*' and 203*b*' of the linear actuators are mechanically connected by blocks (not visible in the drawings) to each half (200*a* and 200*b*) of the coil main frame assembly. The central top drive frame assembly also contains the bearing blocks for linear slides 202*a* (bearing blocks 204 visible for linear slides 202*a* in the drawings) and 202*b* which are respectively fixed to the coil main frame assembly halves 200*a* and 200*b* such that extraction or retraction of the actuators 203*a* and 203*b* causes the coil main frame halves 200*a* and 200*b* to slide its connected linear rail through the associated linear bearing blocks, which in turn causes the coil main frame assembly halves to close (retraction of the actuators) or open (extraction of the actuators) in a linear direction transverse (X-axis) to the axial length of a pipe section located in the pipe treatment region.

In alternate examples of the invention the coil main frame assembly driver system may comprise a single or dual pivot clam shell action as adopted from the prior art in combination with the features of the present invention disclosed herein.

Typically the closing and opening operation of each coil main frame half would be synchronized to act together, either by mechanical linkage or electrical control means, although this is not a necessary feature of the invention. Also before achieving the opened position, pinion drive 408 must have rotated arcuate rack 406 to a home position as shown in FIG. 3(*c*) before opening of the coil main frame assembly and before apparatus 100 is to be lifted up from around or taken away from the pipe section within the pipe treatment region. For example when first coating head cartridge 500*a* is located at the 180 degrees position in FIG. 4(*b*) and FIG. 4(*c*) arcuate rack 406 (partially shown in this cross section) extends around a lower portion of a pipe section which would prevent lifting opened apparatus 100 up from around the pipe since the arcuate rack is not rotated to the home position as shown in FIG. 3(*c*) for the entire arcuate rack.

In typical horizontal heating and/or coating operation, an induction coil assembly 300 of suitable diameter and design is pre-mounted in coil main frame assembly 200. One or more coating head cartridges, such as, for example, cartridges 500*a* and 500*b* in the previous examples (in quantities as required for a particular application) if not already fastened to coating head cartridge mounting systems 507 and 517, that respectively include lever arms 505 and 515, and support brackets 506 and 516 that connect the coating head cartridges to the coating head drive assemblies as described above, will be so fastened. If spring loaded coating head mounting systems are not used, then actuated lever arm coating head mounting and positioning systems may be embodied as described previously. With the arcuate rack 406 located within the coating head cartridges side outer drive assembly housings to clear the pipe section to be treated as described above, apparatus 100 with induction coil assembly 300 mounted in the coil main frame assembly 200 would be moved to the opened position as shown in FIG. 6(*a*) and lowered down over the pipe section to be treated. Pipe rollers and tensioners would then be moved to the activated positions, using linear actuators 450 and linkage bars 451, and the coil main frame assembly moved to the closed positioned as shown in FIG. 6(*b*) and described above. The coil main frame assembly lock system, which includes locking rods 464, locks the coil main frame assembly in the closed position for treatment of the pipe section in the pipe treatment region (and also the removable induction coil assembly if installed therein). For example locking rods 464 in the right hand section 200*b* of the coil main frame assembly 200 will protrude into the left hand section 200*a* of the coil main frame assembly where they can be latched into locked position. Once locked in position the coating and/or heating process steps can then be performed around the outer diameter of the pipe section within the pipe treatment region of closed apparatus 100 by supply of coating material to the rotating coating head cartridge assemblies (if used) and/or supply of alternating current power to the induction coil(s) forming the induction coil assembly (if used) as further described above.

In typical heating and/or coating vertical operation, an induction coil assembly 300 of suitable diameter and design is pre-mounted in coil main frame assembly 200. Coating head cartridges, such as, for example, coating head cartridges 500*a* or 500*b* (in quantities as required for a particular application) if not already fastened to coating head cartridge mounting systems 507 and 517, that respectively include lever arms 505 and 515, and support brackets 506 and 516, that connect the coating head assemblies to the coating head drive assemblies as described above, will be so fastened. If spring loaded coating head mounting systems are not used, then actuated lever arm coating head mounting and positioning systems may be embodied as described previously. With the arcuate rack 406 located within the coating heads drive housing to clear the pipe section to be treated, apparatus 100 with induction coil assembly 300 mounted in the coil main frame assembly 200 would be moved to the opened position as shown in FIG. 6(*a*) and presented by other equipment to, and then, around the side of the pipe section to be treated. Pipe rollers and tensioners would then be moved to the activated positions if required, and the coil main frame assembly moved to the closed positioned as shown in FIG. 6(*b*). The coil main frame lock system, which includes locking bars 464, would be deployed as described above, and the coating and/or heating process steps can then be performed around the outer diameter of the pipe section within the closed apparatus by supply of coating material to the rotating coating head cartridge assemblies (if used) and/or supply of alternating current power to the induction coil(s) forming the induction coil assembly (if used) as further described above.

Although two coating head cartridges 500 and one drive pinion 408 and arcuate rack 406 are used in an above example of the invention, it is within the scope of the present invention to alter the number of coating head cartridges and/or the number of drive pinions and arcuate racks, or the arrangement of the drive pinions, arcuate rack and other components of a coating head drive assembly to achieve the required rotation of the coating head cartridge assemblies around the exterior diameter of the pipe section within the pipe treatment region of a closed apparatus 100 of the present invention.

Although a single solenoidal coil is used in the above examples of the invention, it is within the scope of the present invention to use induction coils or inductors of different configurations and quantities within the induction coil assembly cartridge.

Although the embodiment of the apparatus 100 used in the examples above depict generally an induction coil assembly 300, of varying configuration and type, fitted within the coil main frame assembly 200 to effect a heating operation on a pipe section, it is within the scope of the present invention to use one or more induction coils or inductors of various configurations (such as but not limited to those commonly known in the art as solenoids, pancakes, hairpins, split return inductors etc, with or without flux enhancing or altering magnetic and non-magnetic shield or concentrator components fitted) mounted around the periphery of the arcuate rack 406 as depicted in four exemplary combinations in FIG. 9(*a*) through FIG. 9(*d*), such that rotation of the arcuate rack by the apparatus around the pipe in the pipe treatment region as previously described will effect induction heating on the surface of the pipe by rotation of both the inductor(s) and coating head assembly (or assemblies) in quantities and arc sector(s) as indicated by the doubled head arrows with appropriate overlaps as previously mentioned above for other examples of the invention with coating head cartridge assembly rotation only. That is modular apparatus 100*a* through 100*d* in FIG. 9(*a*) through FIG. 9(*d*) are similar to the previous examples of modular apparatus 100 except that the inductor(s) are not mounted within the coil main frame assembly 200, and are mounted, directly or indirectly, to the arcuate rack in modified left and right hand side outer drive frame assemblies (modified right hand side outer drive frame assembly 400*b*' shown in the figures) in similar fashion as the rotating coating head cartridge(s) are mounted. Also modified central top drive assembly 201' is modified to drive the one or more rotating inductor assemblies in addition to the rotating coating head cartridges. In conjunction with these induction coil(s) or inductor(s) mounted around the arcuate rack can be mounted optionally mounted one or more coating head cartridges, as previously described to effect a coating onto the surface of the pipe, as depicted in FIG. 9(*a*) through FIG. 9(*d*). That is in the FIG. 9(*a*) apparatus 100*a* example one rotating inductor assembly and one rotating coating head cartridge (assembly) is used with inductor and coating head rotation of at least 360 degrees; in the FIG. 9(*b*) apparatus 100*b* example two rotating inductor assemblies and two rotating coating head cartridges (assemblies) are used with each of two inductor and coating head pairs rotating at least 180 degrees; in the FIG. 9(*c*) apparatus 100*c* example four rotating inductor assemblies and four rotating coating head cartridges (assemblies) are used with each of four inductor and coating head pairs rotating at least 90 degrees; and in the FIG. 9(*d*) apparatus 100*d* example eight rotating inductor assemblies and eight rotating coating head cartridges (assemblies) are used with each of eight inductor and coating head pairs rotating at least 45 degrees.

Thus from the above disclosure an apparatus of the present invention may be an electric induction heating and coating apparatus, or selectively an induction heating or coating apparatus, with an induction coil assembly mounted and one or more coating heads mounted, or only an electric induction heating apparatus with an induction coil assembly mounted and no coating head cartridge mounted in the apparatus, or only a coating apparatus with only one or more coating head cartridges mounted and no induction coil assembly mounted in the apparatus for heat and/or coating treatment of a pipe section in a pipe treatment region within the apparatus.

Although not limited thereto, the apparatus and methods of the present invention are most favorably applied to metal or composite pipes having at least some electrically conductive component (when heat treatment is performed) with exterior pipe diameters generally in the range of 4 to 86 inches (0.1 to 2.2 meters) as typically used to transport liquids, gases or other media either before treatment (extracted typically from natural terrain) or after treatment (supply/distribution for consumption or transportation to storage). Such applications may occur in field pipe laying activity (across land areas or under water) or in factory manufacture or site prefabrication processes, where pipes are joined into strings prior to laying.

The examples of the invention include reference to specific electrical and mechanical components. One skilled in the art may practice the invention by substituting components that are not necessarily of the same type but will create the desired conditions or accomplish the desired results of the invention. For example, single components may be substituted for multiple components or vice versa.

The invention claimed is:

1. A modular apparatus for electric induction heating or coating of an exterior surface of a pipe, or for the combination of electric induction heating and coating of the exterior surface of the pipe, the modular apparatus comprising:

an interchangeable central main frame assembly, the interchangeable central main frame assembly comprising a central top drive frame assembly and a coil main frame assembly, the central top drive frame assembly disposed above the coil main frame assembly, the central top drive frame assembly comprising a coating system driver and a coil main frame assembly driver system for moving the coil main frame assembly between a closed coil main frame assembly position when the coil main frame assembly forms an encircling closed coil main frame assembly around an axial section of the pipe in a pipe treatment region and an opened coil main frame assembly position when the coil main frame assembly forms an opening for the entry or exit of the axial section of the pipe to or from the pipe treatment region;

a coil assembly mounting structure located on the coil main frame assembly;

a first and a second side outer drive frame assemblies, the first and second side outer drive frame assemblies respectively and removably connected to a first and second sides of the interchangeable central main frame assembly whereby the axial section of the pipe can pass through the first side outer drive frame assembly, the pipe treatment region of the encircling closed coil main frame assembly and the second side outer drive frame assembly, the first and second side outer drive frame assemblies detachable from the interchangeable central main frame assembly for replacement of the interchangeable central main frame assembly for use with the first and second side outer drive frame assemblies to form a modified pipe treatment region; and a first and second coating head mounting structures located respectively in the first and second side outer drive frame assemblies, the first and second coating head mounting structures connected respectively to a first and second coating head drive assembly located respectively in the first and second side outer drive frame assemblies, the first and second coating head drive assemblies connected to the coating system driver.

2. The modular apparatus of claim 1 further comprising an interchangeable induction coil assembly mounted to the coil assembly mounting structure whereby the interchangeable induction coil assembly moves with the coil main frame assembly to the closed coil main frame assembly position to form an encircling closed interchangeable induction coil assembly around the exterior surface of the pipe in the axial section of the pipe in the pipe treatment region and to the opened coil main frame assembly position to form the opening for the entry or exit of the axial section of the pipe to or from the pipe treatment region.

3. The modular apparatus of claim 2 wherein the interchangeable induction coil assembly comprises one or more coil turns.

4. The modular apparatus of claim 3 wherein the one or more coil turns comprises one or more solenoidal coils.

5. The modular apparatus of claim 4 wherein the one or more coil turns are formed from a plurality of coil turns and the plurality of coil turns are arranged in one or more groups of coil turns, each of the one or more groups of coil turns adjustably arranged along the axial section of the pipe in the pipe treatment region.

6. The modular apparatus of claim 4 wherein the interchangeable induction coil assembly comprises a first and second coil assembly halves terminating and mating in a plurality of complimentary pairs of female and male electrical contact assemblies when the coil main frame assembly is in the closed coil main frame assembly position.

7. The modular apparatus of claim 6 further comprising a positive air pressure purge apparatus to create an air gas flow through the plurality of complimentary pairs of female and male electrical contact assemblies.

8. The modular apparatus of claim 1 further comprising one or more interchangeable coating head cartridges mounted to the first and second coating head mounting structures, each of the one or more interchangeable coating head cartridges comprising one or more coating pans connectable to a source of a coating material for release of the coating material from the one or more coating pans onto the exterior surface of the pipe in the pipe treatment region.

9. The modular apparatus of claim 8 further comprising a means of adjustably mounting each one of the one or more interchangeable coating head cartridges to the first and second coating head mounting structures relative to the radial distance from each one of the one or more interchangeable coating head cartridges to the exterior surface of the pipe in the pipe treatment region.

10. The modular apparatus of claim 9 further comprising a means for positioning the one or more interchangeable coating head cartridges mounted to the first and second coating head mounting structures relative to the radial distance from each one of the one or more interchangeable coating head cartridges to the exterior surface of the pipe in the pipe treatment region to a coating process position at least when the coil main frame assembly is in the closed coil main frame assembly position and to a retracted coating head position at least when the coil main frame assembly is in the opened coil main frame assembly position.

11. The modular apparatus of claim 10 wherein the first and second coating head drive assemblies comprise a first and second arcuate rack located respectively in the first and second side outer drive assemblies, the first and second arcuate racks extending circumferentially around the exterior of a first and second pipe sections respectively within the first and second side outer drive assemblies, the first and second arcuate racks rotationally driven respectively around the exterior surfaces of the first and second pipe sections by engaging a first and second rotationally powered drive pinion located respectively in the first and second side outer drive assemblies, the first and second rotationally powered drive pinions connected to the coating system driver and thereby rotating the one or more coating head cartridges around the exterior of the pipe within the pipe treatment region.

12. The modular apparatus of claim 1 further comprising a pipe positioning means or a pipe tensioning means connected to the outboard side of either the first or second side outer drive frame assemblies.

13. The modular apparatus of claims 1 wherein the coil main frame assembly driver system comprises:

a pair of transverse linear actuators; and a pair of transverse linear slide bearings, the pair of transverse linear actuators transversely extending the pair of transverse linear slide bearings to move the coil main frame assembly from the closed coil main frame assembly position to the opened coil main frame assembly position, and the pair of transverse linear actuators transversely retracting the pair of transverse linear slide bearings to move the coil main frame assembly from the opened coil main frame assembly position to the closed coil main frame assembly position.

14. A modular apparatus for electric induction heating electric induction heating and coating of an exterior surface of a pipe, the modular apparatus comprising:

an interchangeable central main frame assembly, the interchangeable central main frame assembly comprising a central top drive frame assembly and a coil main frame assembly, the central top drive frame assembly disposed above the coil main frame assembly, the central top drive frame assembly comprising a coating system driver and a coil main frame assembly driver system for moving the coil main frame assembly between a closed coil main frame assembly position when the coil main frame assembly forms an encircling closed coil main frame assembly around an axial section of the pipe in a pipe treatment region and an opened coil main frame assembly position when the coil main frame assembly forms an opening for the entry or exit of the axial section of the pipe to or from the pipe treatment region;

a coil assembly mounting structure located on the coil main frame assembly;

an interchangeable induction coil assembly mounted to the coil assembly mounting structure whereby the interchangeable induction coil assembly moves within the coil main frame assembly to the closed coil main frame assembly position to form an encircling closed interchangeable induction coil assembly around the exterior surface of the pipe in the axial section of the pipe in the pipe treatment region and to the opened coil main frame assembly position to form the opening for the entry or exit of the axial section of the pipe to or from the pipe treatment region;

a first and a second side outer drive frame assemblies, the first and second side outer drive frame assemblies respectively and removably connected to a first and second sides of the interchangeable central main frame assembly whereby the axial section of the pipe can pass through the first side outer drive frame assembly, the pipe treatment region of the encircling closed coil main frame assembly and the second side outer drive frame assembly, the first and second side outer drive frame assemblies detachable from the interchangeable central main frame assembly for replacement of the interchangeable central main frame assembly for use with the first and second side outer drive frame assemblies to form a modified pipe treatment region;

a first and second coating head mounting structures located respectively in the first and second side outer drive frame assemblies, the first and second coating head mounting structures connected respectively to a first and second coating head drive assembly located respectively in the first and second side outer drive frame assemblies, the first and second coating head drive assemblies connected to the coating system driver; and one or more interchangeable coating head cartridges mounted to the first and second coating head mounting structures, each of the one or more interchangeable coating head cartridges comprising one or more coating pans connectable to a source of a coating material for release of the coating material from the one or more coating pans onto the exterior surface of the pipe in the pipe treatment region.

15. The modular apparatus of claim 14 wherein the interchangeable induction coil assembly comprises one or more coil turns.

16. The modular apparatus of claim 15 wherein the one or more coil turns comprises one or more solenoidal coils.

17. The modular apparatus of claim 14 further comprising:

a means of adjustably mounting each one of the one or more interchangeable coating head cartridges to the first and second coating head mounting structures relative to the radial distance from each one of the one or more interchangeable coating head cartridges to the exterior surface of the pipe in the pipe treatment region;

a means for positioning the one or more interchangeable coating head cartridges mounted to the first and second coating head mounting structures relative to the radial distance from each one of the one or more interchangeable coating head cartridges to the exterior surface of the pipe in the pipe treatment region to a coating process position at least when the coil main frame assembly is in the closed coil main frame assembly position and to a retracted coating head position at least when the coil main frame assembly is in the opened coil main frame assembly position; and the first and second coating head drive assemblies comprising a first and second arcuate rack located respectively in the first and second side outer drive assemblies, the first and second arcuate racks extending circumferentially around the exterior of a first and second pipe sections respectively within the first and second side outer drive assemblies, the first and second arcuate racks rotationally driven respectively around the exterior surfaces of the first and second pipe sections by engaging a first and second rotationally powered drive pinion located respectively in the first and second side outer drive assemblies, the first and second rotationally powered drive pinion 408 connected to the coating system driver and thereby rotating the one or more coating head cartridges around the exterior surfaces of the pipe within the pipe treatment region.

* * * * *